US012605026B2

(12) United States Patent
Jun et al.

(10) Patent No.: US 12,605,026 B2
(45) Date of Patent: Apr. 21, 2026

(54) SHOE CARE DEVICE FOR CONTROLLING CLEANING OPERATION OF ROBOTIC VACUUM CLEANER AND METHOD OF CONTROLLING THE SAME

(71) Applicant: Samsung Electronics Co., Ltd., Suwon-si (KR)

(72) Inventors: Joonsik Jun, Suwon-si (KR); Heungryong Oh, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 568 days.

(21) Appl. No.: 18/168,213

(22) Filed: Feb. 13, 2023

(65) Prior Publication Data

US 2023/0255433 A1 Aug. 17, 2023

Related U.S. Application Data

(63) Continuation of application No. PCT/KR2023/001530, filed on Feb. 2, 2023.

(30) Foreign Application Priority Data

Feb. 16, 2022 (KR) ..... 10-2022-0020397

(51) Int. Cl.
*A47L 11/40* (2006.01)

(52) U.S. Cl.
CPC ..... *A47L 11/4011* (2013.01); *A47L 11/4008* (2013.01); *A47L 2201/06* (2013.01)

(58) Field of Classification Search
CPC ..... A47L 11/4011; A47L 11/4008; A47L 2201/06; A47L 9/28; A47L 11/40; A47L 2201/04; A47L 23/02; A47L 23/20; A47L 23/205; A47L 9/2852; H04L 2012/285; H04L 12/28; H04L 12/2818;
(Continued)

(56) References Cited

U.S. PATENT DOCUMENTS 11,257,596 B2 2/2022 Cho et al.
11,925,306 B2 3/2024 Brouwers et al.
(Continued)

FOREIGN PATENT DOCUMENTS

CN 108095348 A 6/2018
CN 212037442 U * 12/2020
(Continued)

OTHER PUBLICATIONS

English Translation of "CN-212037442-U" (Year: 2020).*
(Continued)

*Primary Examiner* — Charles R Kasenge
(74) *Attorney, Agent, or Firm* — Jefferson IP Law, LLP

(57) ABSTRACT

A method of controlling a shoe care device is provided. The method includes obtaining contamination level information of shoes by using at least one sensor, performing a shoe care operation in one operation mode among a plurality of operation modes, determining whether to transmit a cleaning request to at least one robotic vacuum cleaner, based on at least one of the contamination level information of shoes or the operation mode being performed, and transmitting the cleaning request to the at least one robotic vacuum cleaner, based on a determination to transmit the cleaning request.

20 Claims, 19 Drawing Sheets

(58) Field of Classification Search
CPC ..... H04L 12/282; H04L 12/2825; H04L 12/2827; H04L 67/125; H04M 1/72415; H04M 1/72412; A47B 61/04; F26B 21/001; F26B 21/004; F26B 21/006; F26B 21/04; F26B 21/086; F26B 25/22; G16Y 20/20; G16Y 40/30; G16Y 10/80; H04W 4/80
See application file for complete search history.

(56) References Cited

U.S. PATENT DOCUMENTS

| | | | |
|---|---|---|---|
| 2019/0038105 | A1 | 2/2019 | Park et al. |
| 2020/0008639 | A1 | 1/2020 | Lee et al. |
| 2020/0046193 | A1 | 2/2020 | Chae |
| 2021/0161351 | A1 | 6/2021 | Lee et al. |
| 2021/0401262 | A1 | 12/2021 | Yoo et al. |
| 2021/0405867 | A1 | 12/2021 | Yoo et al. |
| 2022/0412579 | A1 | 12/2022 | Kim et al. |

FOREIGN PATENT DOCUMENTS

| | | | |
|---|---|---|---|
| CN | 113123095 | A | 7/2021 |
| EP | 4 203 760 | B1 | 11/2023 |
| JP | 2021-7612 | A | 1/2021 |
| JP | 2021-118849 | A | 8/2021 |
| KR | 10-2015-0024027 | A | 3/2015 |
| KR | 10-2011827 | B1 | 8/2019 |
| KR | 10-2014057 | B1 | 8/2019 |
| KR | 10-2019-0106891 | A | 9/2019 |
| KR | 10-2020-0068033 | A | 6/2020 |
| KR | 10-2172717 | B1 | 11/2020 |
| KR | 10-2021-0097469 | A | 8/2021 |
| KR | 10-2021-0158769 | A | 12/2021 |
| KR | 10-2022-0007805 | A | 1/2022 |
| KR | 10-2022-0109870 | A | 8/2022 |
| KR | 10-2022-0109946 | A | 8/2022 |
| KR | 10-2022-0141627 | A | 10/2022 |
| KR | 10-2022-0163193 | A | 12/2022 |
| KR | 10-2023-0001912 | A | 1/2023 |
| KR | 10-2023-0149639 | A | 10/2023 |
| KR | 10-2600074 | B1 | 11/2023 |
| WO | 2019/216578 | A1 | 11/2019 |

OTHER PUBLICATIONS

European Search Report dated Jan. 3, 2025, issued in European Application No. 23756550.2.
International Search Report dated May 18, 2023, issued in International Application No. PCT/KR2023/001530.

* cited by examiner

FIG. 9

| OPERATION MODE | REQUEST CLEANING? | TYPE OF CLEANING |
|---|---|---|
| DAILY CARE MODE | ○ | DUST |
| PRE-OUTING | × | |
| STRONG | ○ | DUST, DAMP CLOTH |
| HIKING BOOTS | ○ | DUST, DAMP CLOTH |
| SHOES | ○ | DUST |
| GOLF SHOES | ○ | DUST |
| RAIN BOOTS | ○ | DAMP CLOTH |
| BOOTS | ○ | DUST |
| WET SNEAKERS | ○ | DAMP CLOTH |

SHOE CARE DEVICE FOR CONTROLLING CLEANING OPERATION OF ROBOTIC VACUUM CLEANER AND METHOD OF CONTROLLING THE SAME

CROSS-REFERENCE TO RELATED APPLICATION(S)

This application is a continuation application, claiming priority under § 365(c), of an International application No. PCT/KR2023/001530, filed on Feb. 2, 2023, which is based on and claims the benefit of a Korean patent application number 10-2022-0020397, filed on Feb. 16, 2022, in the Korean Intellectual Property Office, the disclosure of which is incorporated by reference herein in its entirety.

TECHNICAL FIELD

The disclosure relates to a shoe care device operating in conjunction with a robotic vacuum cleaner, a method of controlling the shoe care device, and a computer-readable recording medium having recorded thereon a computer program for performing the method of controlling the shoe care device.

BACKGROUND ART

Shoe care devices for caring for shoes have been used. Shoe care devices remove dust, humidity, etc. from shoes and care for shoes to be in a comfortable state in order to store shoes and care for the condition of the shoes. Users may improve and care for the condition of shoes by storing the shoes in shoe care devices after going out. Such shoe care devices may be connected to the Internet and in conjunction with other Internet of Things (IoT) devices.

Meanwhile, robotic vacuum cleaners may clean determined areas at a time determined by users. For example, a user may set a time and area for a robotic vacuum cleaner to perform a cleaning operation by using a device such as a smart phone, and the robotic vacuum cleaner may clean the set area at a time set by the user. However, processes in which a user directly sets a time and area for a robotic vacuum cleaner to perform cleaning may consume the time and effort of the user, which may cause inconvenience.

The above information is presented as background information only to assist with an understanding of the disclosure. No determination has been made, and no assertion is made, as to whether any of the above might be applicable as prior art with regard to the disclosure.

DESCRIPTION OF EMBODIMENTS

Technical Solution To Problem

Aspects of the disclosure are to address at least the above-mentioned problems and/or disadvantages and to provide at least the advantages described below. Accordingly, an aspect of the disclosure is to provide a shoe care device operating in conjunction with a robotic vacuum cleaner, a method of controlling the shoe care device, and a computer-readable recording medium having recorded thereon a computer program for performing the method of controlling the shoe care device.

Additional aspects will be set forth in part in the description which follows and, in part, will be apparent from the description, or may be learned by practice of the presented embodiments.

In accordance with an aspect of the disclosure, a method of controlling a shoe care device is provided. The method includes obtaining contamination level information of shoes by using at least one sensor, performing a shoe care operation in one operation mode from among a plurality of operation modes, determining whether to transmit a cleaning request to at least one robotic vacuum cleaner, based on at least one of the contamination level information of the shoes or the operation mode being performed, and transmitting the cleaning request to the at least one robotic vacuum cleaner, based on a determination to transmit the cleaning request.

In accordance with an aspect of the disclosure, a shoe care device is provided. The shoe care device includes a container storing at least one pair of shoes, at least one sensor configured to measure a contamination level of the at least one pair of shoes stored in the container, a shoe care module configured to care for a state of the at least one pair of shoes inside the container, a communication module, a memory storing at least one instruction, and at least one processor connected to the memory, wherein the at least one processor is configured to execute the at least one instruction to obtain contamination level information of shoes by using a measurement value of the at least one sensor, control the shoe care module to perform a shoe care operation in one operation mode among a plurality of operation modes, determine whether to transmit a cleaning request to the at least one robotic vacuum cleaner, based on at least one of the contamination level information of shoes or the operation mode being performed, and control the communication module to transmit a cleaning request to the at least one robotic vacuum cleaner, based on determination to transmit the cleaning request.

In accordance with an aspect of the disclosure, a computer-readable recording medium having recorded thereon a computer program for performing the method of controlling the shoe care device, on a computer is provided.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF DRAWINGS

The above and other aspects, features, and advantages of certain embodiments of the disclosure will be more apparent from the following description taken in conjunction with the accompanying drawings, in which:

FIG. 9 is a diagram illustrating determination standards for determining whether to request cleaning based on an operation mode of a shoe care device, according to an embodiment of the disclosure;

Throughout the drawings, like reference numerals will be understood to refer to like parts, components, and structures.

MODE OF DISCLOSURE

Figure 1:
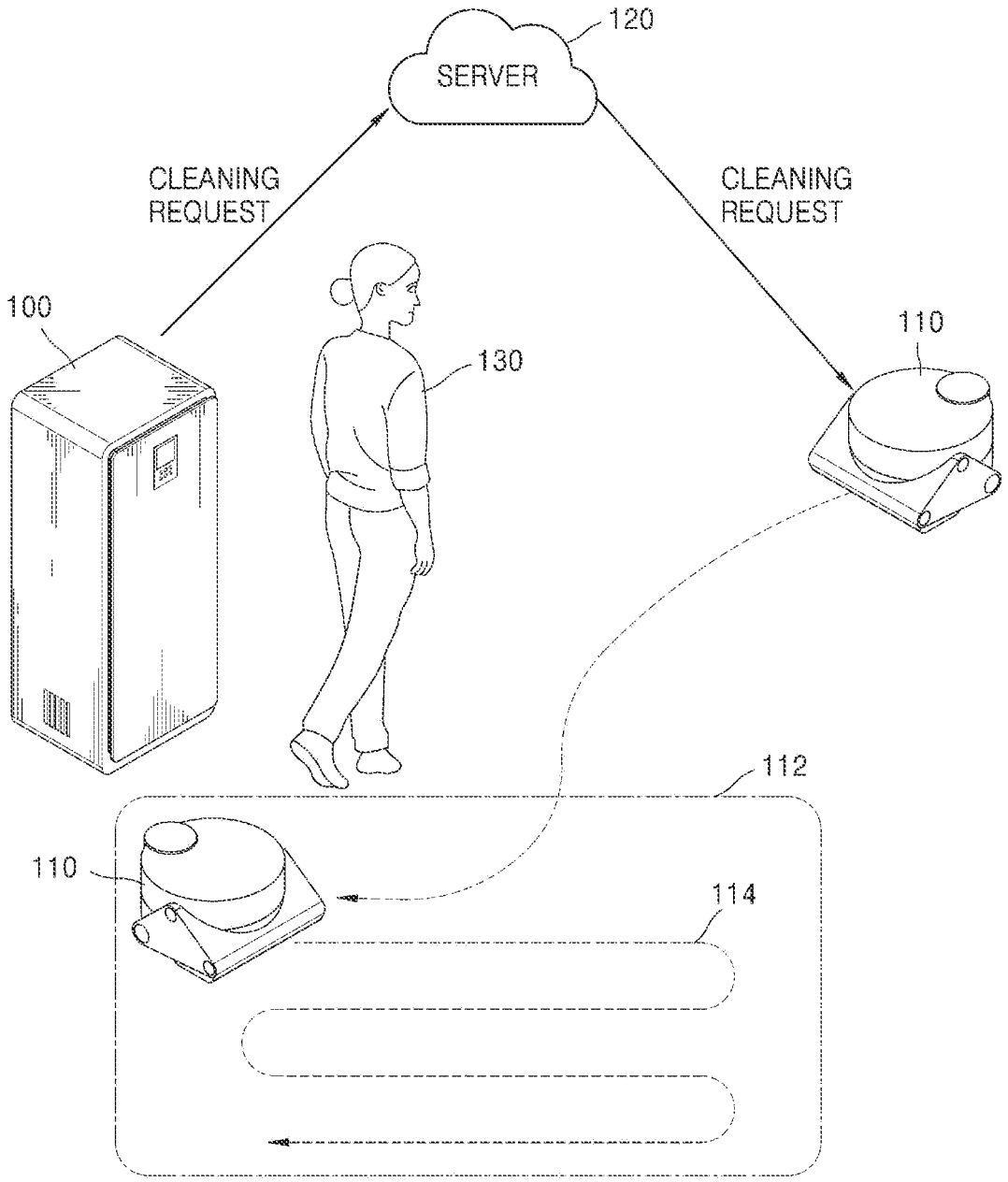
FIG. 1 is a diagram illustrating operations of a shoe care device and a robotic vacuum cleaner, according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Throughout the disclosure, the expression "at least one of a, b or c" indicates only a, only b, only c, both a and b, both a and c, both b and c, all of a, b, and c, or variations thereof.

An embodiment of the disclosure provides a shoe care device in conjunction with a robotic vacuum cleaner to allow the robotic vacuum cleaner to automatically clean areas that need cleaning without user control, a method of controlling the shoe care device, and a recording medium having recorded thereon a computer program for performing the method of controlling the shoe care device.

The disclosure describes and discloses principles of embodiments of the disclosure such that the scope of right of claims are clarified and one of ordinary skill in the art may implement the embodiment of the disclosure described in the claims. The embodiments of the disclosure may be implemented in various forms.

Throughout the specification, like reference numerals denote like elements. The disclosure does not describe all elements of the embodiments of the disclosure, and generic content in the technical field of the disclosure or redundant content of the embodiments of the disclosure is omitted. The term "module" or "unit" used in the specification may be implemented in software, hardware, firmware, or a combination thereof, and according to embodiments of the disclosure, a plurality of "modules" or "units" may be implemented as one element or one "module" or "unit" may include a plurality of elements.

In the description of the embodiment of the disclosure, certain detailed explanations of related art are omitted when it is deemed that they may unnecessarily obscure the essence of the disclosure. Also, numbers (for example, a first, a second, etc.) used in the description of the specification are merely identifier codes for distinguishing one element from another.

Also, in the disclosure, it will be understood that when elements are "connected" or "coupled" to each other, the elements may be directly connected or coupled to each other, but may alternatively be connected or coupled to each other with an intervening element therebetween, unless specified otherwise.

Hereinafter, operation principles and various embodiments of the disclosure will be described with reference to accompanying drawings.

FIG. 1 is a diagram illustrating operations of a shoe care device and a robotic vacuum cleaner according to an embodiment of the disclosure.

Referring to FIG. 1, a shoe care device 100 is a device storing shoes therein and caring for the condition of the shoes. The shoe care device 100 includes a rack for organizing the shoes in a container storing the shoes. The shoe care device 100 circulates internal air to manage dust, odor, humidity, etc. of the shoes so as to care for the condition of the shoes. The shoe care device 100 may be disposed near an entrance of a house, office, commercial space, etc. A user 130 may store shoes in the shoe care device 100 near the entrance or take out the shoes from the shoe care device 100 to put them on.

The shoe care device 100 may communicate with an external device. The shoe care device 100 may be connected to a network through an AP device (not shown) in the house and may communicate with a server 120. The shoe care device 100 may communicate with a robotic vacuum cleaner 110 through the server 120. The shoe care device 100 may be registered in a certain account of the server 120 and communicate with other Internet of Things (IoT) devices registered in the same account. The robotic vacuum cleaner 110 is a device registered in the same account as the shoe care device 100.

The shoe care device 100 transmits a cleaning request to the robotic vacuum cleaner 110 based on at least one of contamination level information of shoes or an operation mode.

The shoe care device 100 collects state information of the shoes when the shoes are stored. The shoe care device 100 obtains contamination level information of the shoes such as dust contamination level and humidity contamination level by using a sensor. The contamination level information is information indicating the contamination level of the shoes. The shoe care device 100 transmits a cleaning request to the robotic vacuum cleaner 110 when it is determined that the stored shoes are contaminated by more than a certain standard.

In addition, the shoe care device 100 operates in various operation modes. The shoe care device 100 may operate, for example, in a daily care mode, a wet sneakers mode, or a pre-outing mode. An operation mode of the shoe care device 100 may be set by the user. The user may set the operation mode of the shoe care device 100 through a user interface of the shoe care device 100 or a mobile device (e.g., a smartphone, a wearable device, a tablet personal computer (PC), etc.) connected to the shoe care device 100 through the server 120. The shoe care device 100 transmits a cleaning request to the robotic vacuum cleaner 110 when operating in a certain operation mode.

The shoe care device 100 transmits a cleaning request to the server 120. The server 120 transmits the cleaning request received from the shoe care device 100 to the robotic vacuum cleaner 110. As an example, the shoe care device 100 may be connected to the robotic vacuum cleaner 110 by using a short-range communication network (e.g., Bluetooth, Wi-Fi Direct, etc.), and the shoe care device 100 may transmit a cleaning request to the robotic vacuum cleaner 110 over the short-range communication network. In the disclosure, the transmitting by the shoe care device 100 of a cleaning request or certain information to the robotic vacuum cleaner 110 includes both a configuration of transmission through the server 120 and a configuration of direction transmission over the short-range communication network.

When receiving the cleaning request from the shoe care device 100, the robotic vacuum cleaner 110 performs cleaning When the robotic vacuum cleaner 110 receives a cleaning request from the shoe care device 100, the robotic vacuum cleaner 110 may clean a certain cleaning area 112 based on the movement of the user 130. The robotic vacuum cleaner 110 may perform cleaning by setting a cleaning path 114 in the cleaning area 112. For example, the robotic vacuum cleaner 110 identifies the movement of the user 130 by using a light detection and ranging (lidar) sensor, or identifies the movement of the user based on the usage state of another IoT device. As an example, the robotic vacuum cleaner 110 may clean a certain area or the entire area of the house without identifying the movement of the user 130.

According to embodiments of the disclosure, the shoe care device 100 which is a device that the user 130 first uses when returning home automatically requests cleaning with the robot cleaner 110, and thus, there is an effect of effectively providing an automatic cleaning function of the robotic vacuum cleaner 110 based on the movement and state of the user 130. In addition, according to embodiments of the disclosure, the shoe care device 100 determines whether to proceed with the cleaning request based on collected information, and thus, there is an effect of proceeding with cleaning according to the state of shoes and the state of the user (e.g., returning home or returning home after going out in the rain).

Figure 2:
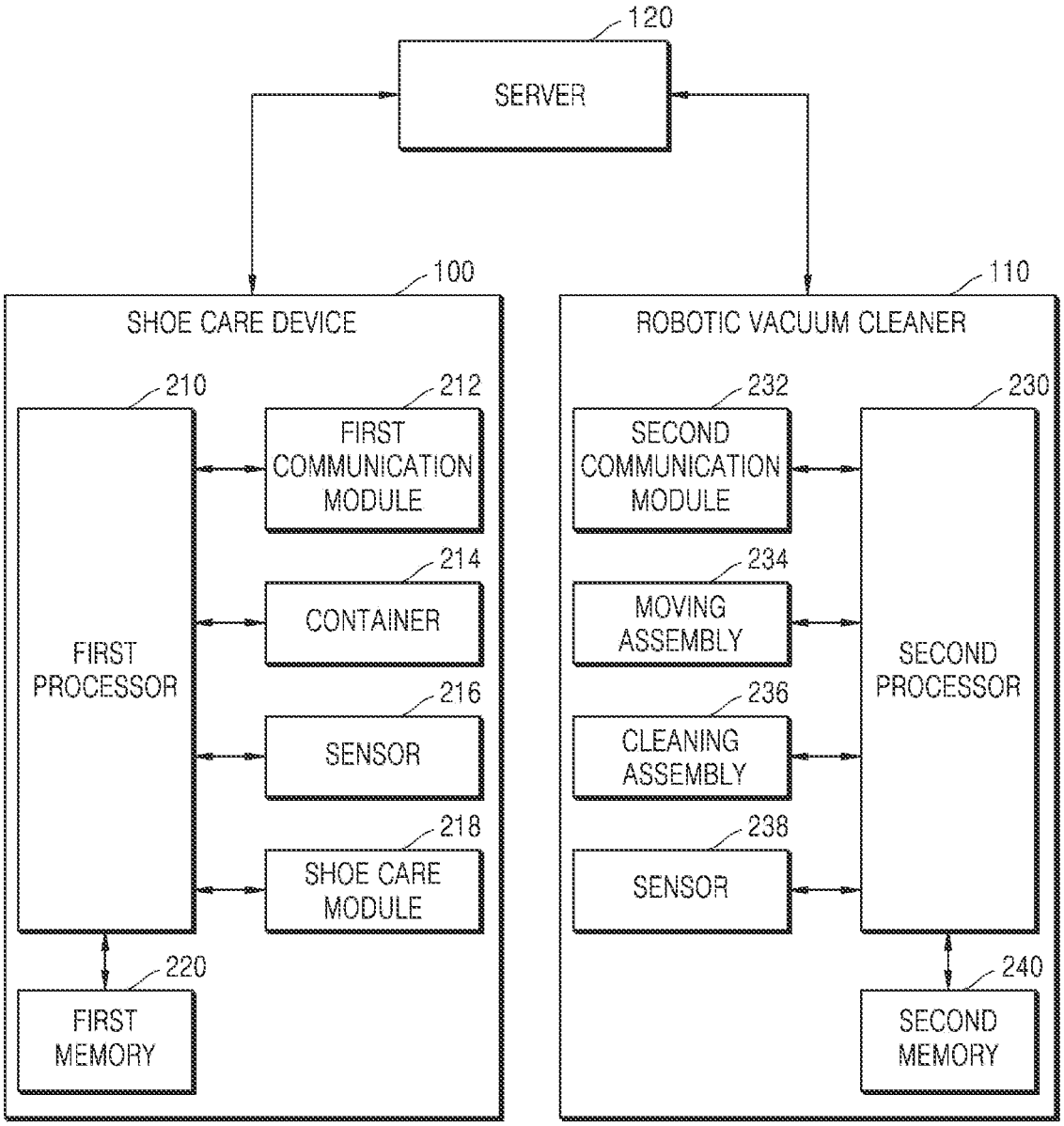
FIG. 2 is a block diagram illustrating structures of a shoe care device, a robotic vacuum cleaner, and a server, according to an embodiment of the disclosure.

FIG. 2 is a block diagram illustrating structures of a shoe care device, a robotic vacuum cleaner, and a server according to an embodiment of the disclosure.

Referring to FIG. 2, the shoe care device 100 includes a first processor 210, a first communication module 212, a container 214, a sensor 216, a shoe care module 218, and a first memory 220.

The first processor 210 controls all operations of the shoe care device 100. The first processor 210 may be implemented as one or more processors. The first processor 210 may execute an instruction or a command stored in the first memory 220 to perform a certain operation.

The first communication module 212 may communicate with an external device such as the server 120 by wire or wirelessly. The first communication module 212 may access an access point (AP) device to transmit/receive a Wi-Fi signal. The first processor 210 may control transmission/reception operations of the first communication module 212.

The first communication module 212 may include a wireless communication module (e.g., a cellular communication module, a short-range wireless communication module, or a global navigation satellite system (GNSS) communication module) or a wired communication module (e.g., a local area network (LAN) communication module or a power line communication module). In addition, the first communication module 212 may perform short-range communication, and may use, for example, Bluetooth, Bluetooth Low Energy (BLE), Near Field Communication, Wi-Fi, wireless local area network (WLAN), Zigbee, Infrared Data Association (IrDA) communication, Wi-Fi Direct (WFD), ultrawideband (UWB), Ant+ communication, etc. As an example, the first communication module 212 may perform long-range communication, and may communicate with an external device through, for example, a legacy cellular network, a fifth generation (5G) network, a next-generation communication network, the Internet, or a computer network (e.g., LAN or wide area network (WAN)), etc.

As an example, the first communication module 212 may use mobile communication and may transmit/receive wireless signals to and from at least one of a base station, an external terminal, or a server over a mobile communication network.

The first communication module 212 communicates with the server 120 or the robotic vacuum cleaner 110. According to an embodiment of the disclosure, the first communication module 212 is connected to an AP device in the house through Wi-Fi communication. The first communication module 212 may communicate with the server 120 or the robotic vacuum cleaner 110 through the AP device.

The container 214 is a storage space provided inside the shoe care device 100. The container 214 may include a rack for hanging and organizing shoes. The container 214 may store one or more shoes.

The sensor 216 detects environment information inside the container 214. The sensor 216 may include one or more sensors. Also, the sensor 216 may include a plurality of types of sensors that detect different types of environment information. The sensor 216 may include, for example, a dust sensor, a humidity sensor, etc.

The sensor 216 may be disposed to face the inside of the container 214 so as to detect the environment information inside the container 214. According to an embodiment of the disclosure, the sensor 216 may be disposed around an intake port or a vent port for circulating air inside the container 214.

The shoe care module 218 is a module for caring for the condition of the shoes organized inside the container 214. The shoe care module 218 circulates the air inside the container 214 to care for the condition of the shoes.

The shoe care module 218 may remove the odor of the shoes by removing a main component of the odor of the shoes. For example, the shoe care module 218 may remove the main component of the odor of the shoes, such as Iso-Butyraldehyde, Isovaleraldehyde, Aceton, Asovaleric acid, and 2.3-Butanedione. The shoe care module 218 may separate odor particles of the shoes from the shoes by passing wind into the shoes, and decompose the separated odor particles with an ultraviolet (UV) odor decomposition filter.

In addition, the shoe care module 218 performs a dehumidification operation to remove humidity from the shoes. The shoe care module 218 detects the humidity of the shoes by using the sensor 216 and removes the humidity of the shoes based on a detected humidity contamination level.

In addition, the shoe care module 218 removes dust from the shoes. The shoe care module 218 separates dust from the shoes using wind or vibration, and removes the separated dust by using a filter structure. The shoe care module 218 may collect dust separated from the shoes through the intake port, and pass the collected air through a filter.

The first memory 220 stores various types of information, data, an instruction, a program, etc. required for operations of the shoe care device 100.

The first memory 220 may include at least one of a volatile memory or a nonvolatile memory, or a combination thereof The first memory 220 may include at least one type of storage medium among a flash memory type, a hard disk type, a multimedia card micro type, a card type memory (e.g., a secure digital (SD) or an extreme digital (XD) memory), random access memory (RAM), static RAM (SRAM), read-only memory (ROM), electrically erasable programmable ROM (EEPROM), programmable ROM (PROM), a magnetic memory, a magnetic disk, or an optical disk Also, the first memory 220 may correspond to a web storage or cloud server performing a storing function on the Internet.

The robotic vacuum cleaner 110 includes a second processor 230, a second communication module 232, a moving assembly 234, a cleaning assembly 236, a sensor 238, and a second memory 240.

The second processor 230 controls all operations of the robotic vacuum cleaner 110. The second processor 230 may be implemented as one or more processors. The second processor 230 may execute an instruction or a command stored in the memory 240 to perform a certain operation.

The second communication module 232 may communicate with an external device such as the server 120 by wire or wirelessly. The second communication module 232 may access an AP device to transmit/receive a Wi-Fi signal. The second processor 230 may control transmission/reception operations of the second communication module 232.

The second communication module 232 may include a wireless communication module (e.g., a cellular communication module, a short-range wireless communication module, or a global navigation satellite system (GNSS) communication module) or a wired communication module (e.g., a local area network (LAN) communication module or a power line communication module). In addition, the second communication module 232 may perform short-range communication, and may use, for example, Bluetooth, Bluetooth Low Energy (BLE), Near Field Communication, Wi-Fi (WLAN), Zigbee, Infrared Data Association (IrDA) communication, Wi-Fi Direct (WFD), ultrawideband (UWB), Ant+ communication, etc. As an example, the second communication module 232 may perform long-range communication, and may communicate with an external device through, for example, a legacy cellular network, a 5G network, a next-generation communication network, the Internet, or a computer network (e.g., LAN or WAN), etc.

As an example, the second communication module 232 may use mobile communication and may transmit/receive wireless signals to and from at least one of a base station, an external terminal, or a server over a mobile communication network.

The second communication module 232 communicates with the server 120 or the shoe care device 100. According to an embodiment of the disclosure, the second communication module 232 is connected to an AP device in the house through Wi-Fi communication. The second communication module 232 may communicate with the server 120 or the shoe care device 100 through the AP device.

The moving assembly 234 moves the robotic vacuum cleaner 110. The moving assembly 234 may be disposed on a lower surface of the robotic vacuum cleaner 110 to move the robotic vacuum cleaner 110 forward and backward, and rotate the robotic vacuum cleaner 110. The moving assembly 234 may include a pair of wheels respectively disposed on left and right edges with respect to a central area of a main body of the robotic vacuum cleaner 110. In addition, the moving assembly 234 may include a wheel motor for applying a moving force to each wheel, and a caster wheel installed in front of the main body to rotate according to the state of a floor surface on which the robotic vacuum cleaner 110 moves and change an angle thereof. The pair of wheels may be symmetrically disposed on the main body of the robotic vacuum cleaner 110.

The cleaning assembly 236 may include a main brush assembly installed on a lower portion of a main body to sweep or scatter dust on the floor and to suck the swept or scattered dust and a side brush assembly installed on the lower part of the main body so as to protrude to the outside and sweep dust from an area different from an area cleaned by the main brush assembly and deliver the dust to the main brush assembly. In addition, the cleaning assembly 236 may include a vacuum cleaning module performing vacuum suction or a damp cloth cleaning module cleaning with a damp cloth.

The sensor 238 detects environment information around the robotic vacuum cleaner 110. The sensor 238 may include various types of sensors, and may include, for example, at least one of a lidar sensor, a fall prevention sensor, an image sensor, an infrared sensor, an ultrasonic sensor, an obstacle sensor, or a mileage detection sensor, or a combination thereof.

The second memory 240 stores various types of information, data, an instruction, a program, etc. required for operations of the robotic vacuum cleaner 110.

The second memory 240 may include at least one of a volatile memory or a nonvolatile memory, or a combination thereof. The second memory 240 may include at least one type of storage medium among a flash memory type, a hard disk type, a multimedia card micro type, a card type memory (for example, a secure digital (SD) or an extreme digital (XD) memory), random access memory (RAM), static RAM (SRAM), read-only memory (ROM), electrically erasable programmable ROM (EEPROM), programmable ROM (PROM), a magnetic memory, a magnetic disk, and an optical disk. In addition, the second memory 240 may correspond to a web storage or a cloud server that performs a storage function on the Internet.

Figure 3:
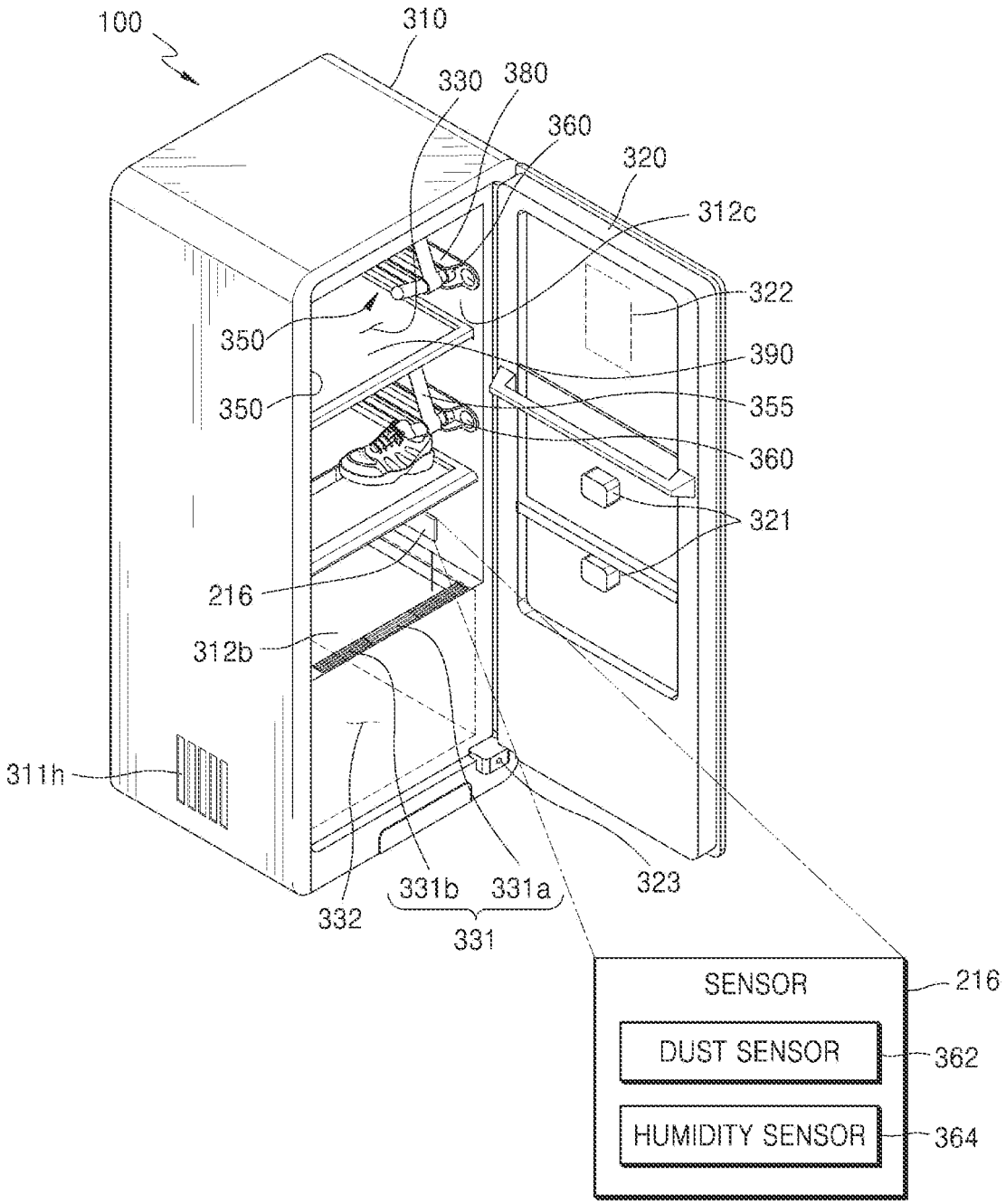
FIG. 3 is a diagram illustrating a structure of a shoe care device according to an embodiment of the disclosure.

FIG. 3 is a diagram illustrating a structure of the shoe care device 100 according to an embodiment of the disclosure.

FIG. 1 illustrates an appearance of the shoe care device 100. FIG. 3 illustrates an inside of the shoe care device 100 of FIG. 1.

Referring to FIG. 3, the shoe care device 100 includes a main body 310 forming an exterior and a door 320 rotatably coupled to the main body 310.

The main body 310 may be provided in a rectangular parallelepiped shape with an open front surface. An opening 310*a* may be formed in the open front surface of the main body 310. The door 320 may be rotatably coupled to the main body 310 to open and close the open front surface of the main body 310. The door 320 may be coupled to the main body 310 by a hinge 323.

An input/output interface 322 may be provided on the front or upper surface of the door 320. The input/output interface 322 may receive various commands from a user. In addition, the input/output interface 322 may display various kinds of information about an operation of the shoe care device 100. For example, the user may select a type of shoes to be cared for by using the input/output interface 322, and may set a care course appropriate for the shoes. An operation mode of the shoe care device 100 is determined according to the selected care course.

The input/output interface 322 may include a display for displaying information about the operation of the shoe care device 100. Also, the input/output interface 322 may include at least one of a button or a touch screen.

In addition, at least one ventilation hole 311*h* for ventilation between air inside of a machine room and air outside thereof may be provided in an outer case constituting the main body 310.

Because the machine room is provided below a chamber 330 inside the main body 310, the ventilation hole 311*h* may be provided in a lower portion of the outer case constituting the main body 310 so as to correspond to the position of the machine room. For example, the ventilation hole 311*h* may be provided in at least one of a side surface or a rear surface of the main body 310.

The door 320 may include a hanging member 321. The hanging member 321 may be provided on one surface of the door 320 facing the inside of the chamber 330, and at least one or more hanging members 321 may be provided. The hanging member 321 may be used for hanging a handle 355 of a rack 350. Storage of the rack 350 may be facilitated by the hanging member 321. The hanging member 321 may be used for other purposes.

The rack 350 on which shoes may be organized may be provided inside the chamber 330. The chamber 330 may form a space in which shoes are accommodated.

The rack 350 and an organizing rail 380 may be provided in the chamber 330. The rack 350 and the organizing rail 380 may be installed on the left side or the right side of the chamber 330. That is, the rack 350 may be installed such that side surfaces of the shoes are visible when viewed from the front of the shoe care device 100. Positions of the rack 350 and the organizing rail 380 are not limited to those illustrated.

At least one or more racks 350 may be provided. The rack 350 may be provided in a shape that may be inserted into the shoes. In addition, the rack 350 is detachable from the chamber 330. That is, the rack 350 may be coupled to the organizing rail 380 provided on the side surface of the chamber 330, or may be separated from the organizing rail 380. The rack 350 is detachable, and thus, a space in the chamber 330 may be efficiently used according to the size of the shoes.

At least one shelf 390 may be provided in the chamber 330. Shoes may be placed on the shelf 390.

The chamber 330 may include an air inlet 360 and an air outlet 331.

The air inlet 360 may be formed in a sidewall of an inner case. For example, the air inlet 360 may be formed in a left side surface 312*c* of the chamber 330. A plurality of air inlets 360 may be provided. Air heated by a condenser may be supplied into the chamber 330 through the air inlet 360. The air inlet 360 may be formed in various shapes.

For example, the shape of the air inlet 360 may be a circle, a square, or a polygon.

The air outlet 331 may be located on a lower surface 312*b* of the chamber 330. For example, the air outlet 331 may be disposed in front of the lower surface 312*b* of the chamber 330. Air in the chamber 330 may flow into a duct through the air outlet 331. The air outlet 331 may include a central hole 331*a* and a grill 331*b* including a plurality of side holes.

A machine room 332 may be provided below the chamber 330. The machine room 332 may be located between the outer case and the inner case. The machine room 332 may be distinguished from the chamber 330 by the inner case.

A compressor, an evaporator, a condenser, an expansion device, a deodorizer, a duct, a fan, a temperature sensor, etc. may be provided in the machine room 332. In addition, a sterilizing device may be provided in the chamber 330 or in the machine room 332.

The container 214 includes the chamber 330 and the rack 350.

The sensor 216 is disposed to face the inside of the chamber 330. The sensor 216 may include various sensors, such as a dust sensor 362, a humidity sensor 364, etc. The sensor 216 may be disposed on the left side surface 312*c*, a right side surface, an upper surface, or the lower surface 312*b* of the chamber 330. According to an embodiment of the disclosure, the sensor 216 may be disposed around each rack 350. According to an embodiment of the disclosure, only one sensor 216 may be disposed at a certain location in the container 214.

Figure 4:
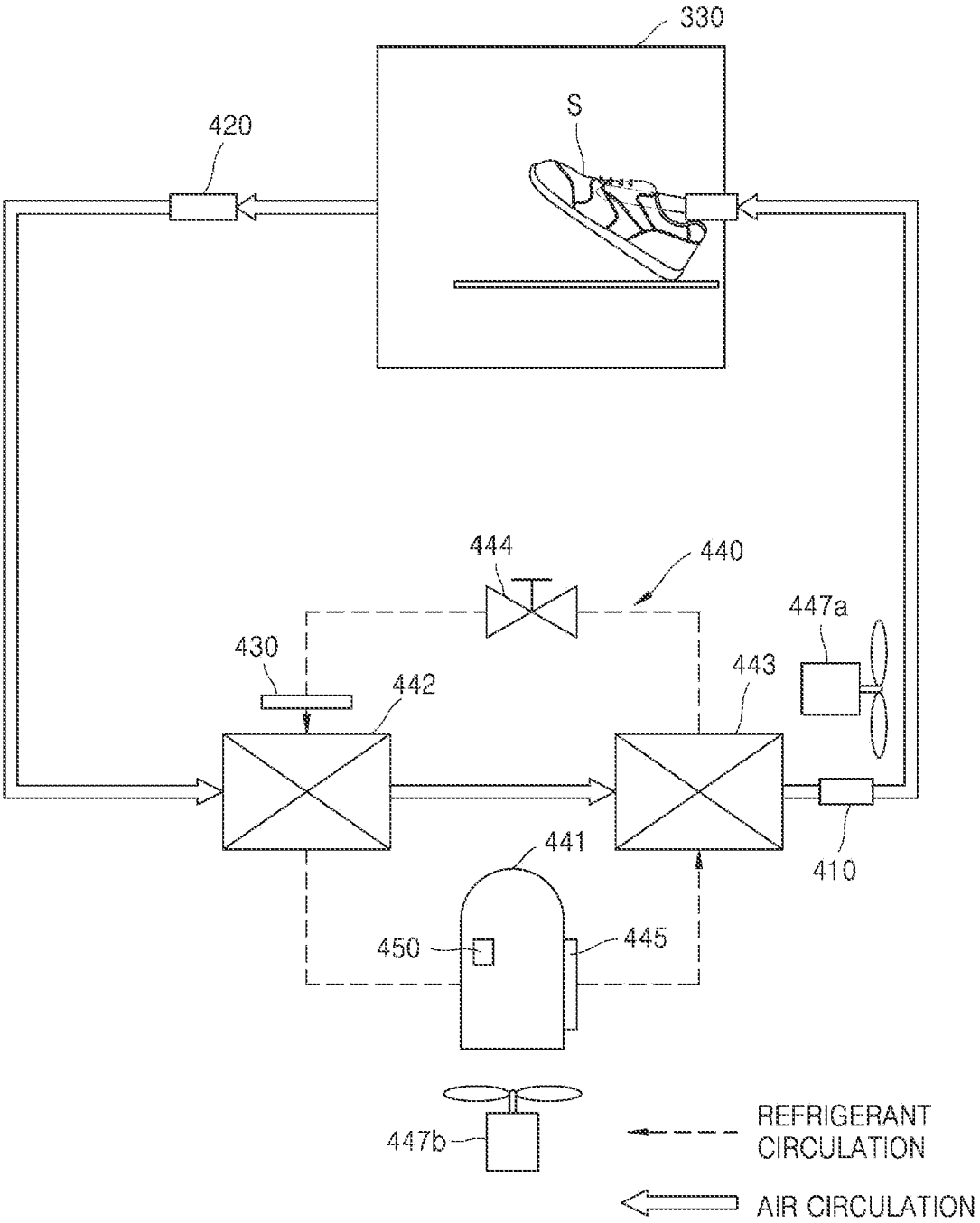
FIG. 4 is a diagram schematically illustrating a flow of air and a flow of a refrigerant in a shoe care device, according to an embodiment of the disclosure.

FIG. 4 is a diagram schematically illustrating a flow of air and a flow of a refrigerant in a shoe care device according to an embodiment of the disclosure.

Referring to FIG. 4, the shoe care device 100 according to an embodiment of the disclosure may include the chamber 330 in which a to-be-dried object S is accommodated, a heat pump device 440 dehumidifying and heating air in the chamber 330 so as to dry the to-be-dried object S, a first temperature sensor 410 measuring a first temperature of the air heated by the condenser 443, a second temperature sensor 420 measuring a second temperature of the air passing through the air outlet 331 of the chamber 330, a first fan 447*a* provided between the heat pump device 440 and the chamber 330 to circulate the air, and a second fan 447*b* provided outside a duct to flow air inside the machine room 332.

The heat pump device 440 includes a compressor 441, a condenser 443, an expansion device 444 and an evaporator 442. The compressor 441, the condenser 443, the expansion device 444, and the evaporator 442 may be connected to each other by a refrigerant pipe to constitute a heat pump cycle, and the refrigerant may circulate according to the heat pump cycle while flowing through the refrigerant pipe. The evaporator 442 and the condenser 443 may be located inside the duct, and the compressor 441 and the expansion device 444 may be located outside the duct.

The compressor 441 compresses a vapor refrigerant of low temperature and low pressure and discharges the vapor refrigerant as a vapor refrigerant of high temperature and high pressure. The discharged vapor refrigerant is introduced into the condenser 443, and the condenser 443 may condense the vapor refrigerant of high temperature and high pressure into a liquid of high pressure or a refrigerant close to the liquid below a condensing temperature. The expansion device 444 expands and reduces the pressure of the liquid of high pressure or the refrigerant close to the liquid that has passed through the condenser 443, and a two-phase refrigerant of low temperature and low pressure that has passed through the expansion device 444 is introduced into the evaporator 442. The evaporator 442 may evaporate the two-phase refrigerant into a vapor refrigerant.

The chamber 330 may be connected to the heat pump device 440 by the duct, and the air in the chamber 330 may move through the duct and circulate between the heat pump device 440 and the chamber 330.

The high temperature and humid air in the chamber 330 passes through the evaporator 442, and therefore, a heat exchange with the refrigerant may be performed. Specifically, the two-phase refrigerant of low temperature and low pressure introduced into the evaporator 442 may absorb heat from the high temperature and humid air passing through the evaporator 442 and may be evaporated into a vapor refrigerant, and the high temperature and humid air passing through the evaporator 442 becomes low temperature and dry after being cooled and simultaneously dehumidified.

The low temperature and dry air that has passed through the evaporator 442 is introduced into the condenser 443, and the heat exchange may be performed between the vapor refrigerant of high temperature and high pressure and the low temperature and dry air in the condenser 443. The vapor refrigerant of high temperature and high pressure may be condensed into the liquid or the refrigerant closed to the liquid to dissipate heat, and the low temperature and dry air may be heated by absorbing the heat discharged during a condensation process of the refrigerant.

The high temperature and dry air that has passed through the condenser 443 may be introduced into the chamber 330 again. Such an air circulation cycle makes it possible to dry the shoes S accommodated in the chamber 330.

The expansion device 444 may be implemented as at least one of a capillary tube or an electronic expansion valve capable of controlling an opening amount by an electrical signal.

The compressor 441 may be implemented as an inverter compressor capable of changing a frequency. The frequency of the compressor 441 means the number of revolutions per second of a motor connected to a compression chamber of the compressor 441. At the start of a drying process, the compressor 441 may operate at a previously determined starting frequency, and then, when the temperature rises, the compressor 441 may operate at an operating frequency. Meanwhile, the compressor 441 may operate within a minimum frequency and maximum frequency range. The minimum operating frequency and the maximum operating frequency may be previously determined according to the design.

The shoe care device 100 may further include a third temperature sensor 430 provided at an entrance side of the evaporator 442 and a fourth temperature sensor 445 provided at a discharge side of the compressor 441. The third temperature sensor 430 may be referred to as an 'evaporator entrance temperature sensor', and the fourth temperature sensor 445 may be referred to as a 'compressor exit temperature sensor'. The third temperature sensor 430 and the fourth temperature sensor 445 may be respectively installed outside or inside the refrigerant pipe to measure the temperature of the refrigerant circulating in the heat pump cycle. The third temperature sensor 430 may measure the temperature of the refrigerant introduced into the evaporator 442, and the fourth temperature sensor 445 may measure the temperature of the refrigerant discharged from the compressor 441.

Also, the shoe care device 100 may further include a current sensor 450 measuring a compressor current applied to the compressor 441. The current sensor 450 may measure power consumed by the compressor 441.

Figure 5:
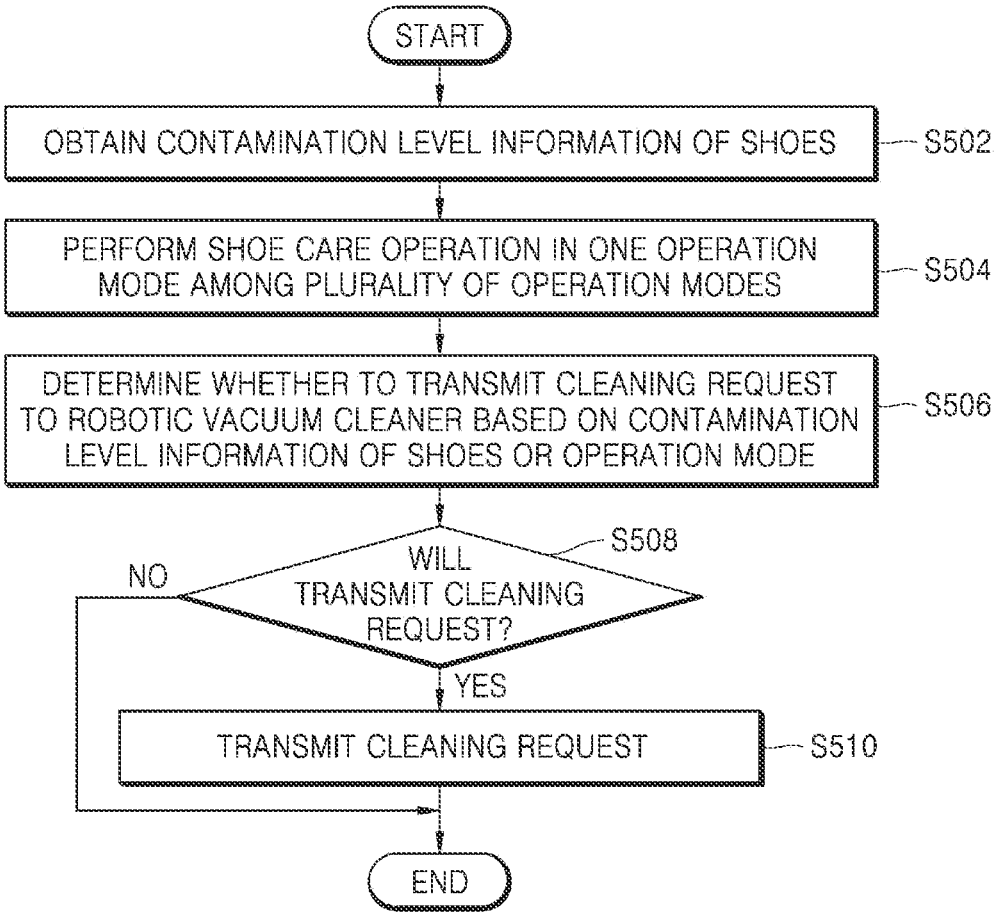
FIG. 5 is a flowchart illustrating a method of controlling a shoe care device, according to an embodiment of the disclosure.

FIG. 5 is a flowchart illustrating a method of controlling a shoe care device according to an embodiment of the disclosure.

The method of controlling the shoe care device according to an embodiment of the disclosure may be performed by the shoe care device 100 according to the embodiments of the disclosure.

Referring to FIG. 5, in operation S502, the shoe care device 100 obtains contamination level information of shoes. The shoe care device 100 obtains the contamination level information of shoes by using at least one sensor. At least one sensor includes, for example, a dust sensor, a humidity sensor, etc. The shoe care device 100 obtains dust contamination level information, humidity contamination level information, etc.

Next, in operation S504, the shoe care device 100 performs a shoe care operation in one operation mode among a plurality of operation modes. The plurality of operation modes may include, for example, a daily care mode, a pre-outing mode, a strong mode, a hiking shoes mode, a shoes mode, a golf shoes mode, a rain boots mode, a boots mode, or a wet sneakers mode. The operation mode may be selected by a user.

Operations S502 and S504 may be performed in parallel. In addition, the order of operations S502 and S504 is not limited to that shown in FIG. 5, and operation S504 may be performed before operation S502.

Next, in operation S506, the shoe care device 100 determines whether to transmit a cleaning request to the robotic vacuum cleaner 110 based on the contamination level information of the shoes or the operation mode being performed. The shoe care device 100 determines to transmit a cleaning request when the contamination level information of the shoes is equal to or greater than a reference value, and determines not to transmit the cleaning request when the contamination level information of the shoes is less than the reference value. The shoe care device 100 may compare the dust contamination level information with a dust reference value and determine whether to transmit the cleaning request. Also, the shoe care device 100 may compare the humidity contamination level information with a humidity reference value and determine whether to transmit the cleaning request.

Next, in operation S508, the shoe care device 100 determines whether it is determined to transmit the cleaning request.

When determining to transmit the cleaning request, in operation S510, the shoe care device 100 transmits the cleaning request to the robotic vacuum cleaner 110. The shoe care device 100 may transmit a cleaning request to the server 120, and the server 120 may transmit a cleaning request to the robotic vacuum cleaner 110. When receiving a cleaning request, the robotic vacuum cleaner 110 performs cleaning according to the cleaning request.

When determining not to transmit the cleaning request, the shoe care device 100 ends the process without transmitting the cleaning request.

According to an embodiment of the disclosure, the process of determining whether to transmit a cleaning request may be performed whenever a certain event occurs. According to an embodiment of the disclosure, the shoe care device 100 may perform the process of FIG. 5 whenever the door 320 of the shoe care device 100 is opened. According to an embodiment of the disclosure, the shoe care device 100 may perform the process of FIG. 5 when a user input for starting shoe care is received from the user.

Figure 6:
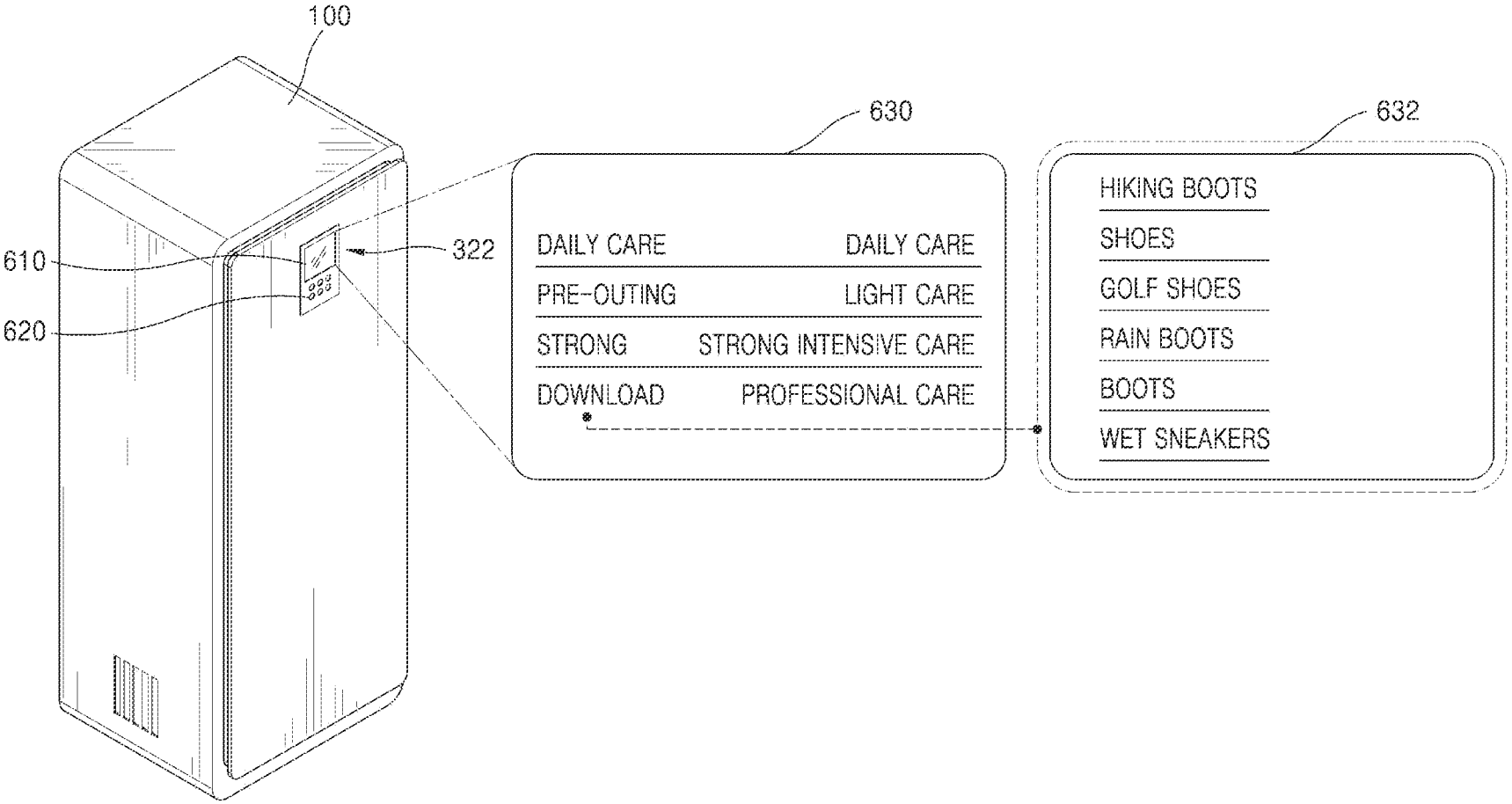
FIG. 6 is a diagram illustrating an operation of an input/output interface of a shoe care device, according to an embodiment of the disclosure.

FIG. 6 is a diagram illustrating an operation of an input/output interface of a shoe care device according to an embodiment of the disclosure.

Referring to FIG. 6, the shoe care device 100 includes an input/output interface 322. The input/output interface 322 may include a display 610, an operation button 620, etc.

The shoe care device 100 may output various kinds of information such as state information of the shoe care device 100, state information of shoes, an operation mode selection menu, a setting menu, etc. through the display 610.

According to an embodiment of the disclosure, the shoe care device 100 outputs a menu for selecting an operation mode through the display 610. The display 610 outputs mode information selectable from a first graphical user interface (GUI) view 630. For example, the first GUI view 630 provides a menu for selecting one of a daily care mode, a pre-outing mode, a strong mode, and a download mode. When a user selects the download mode, the shoe care device 100 provides a selectable download mode from a second GUI view 632. The download mode includes, for example, a hiking shoes mode, a shoes mode, a golf shoes mode, a rain boots mode, a boots mode, or a wet sneakers mode.

The user may select a desired mode by using the operation button 620. According to an embodiment of the disclosure, the display 610 includes a touch screen, and the user may select a desired mode through a touch input.

Figure 7:
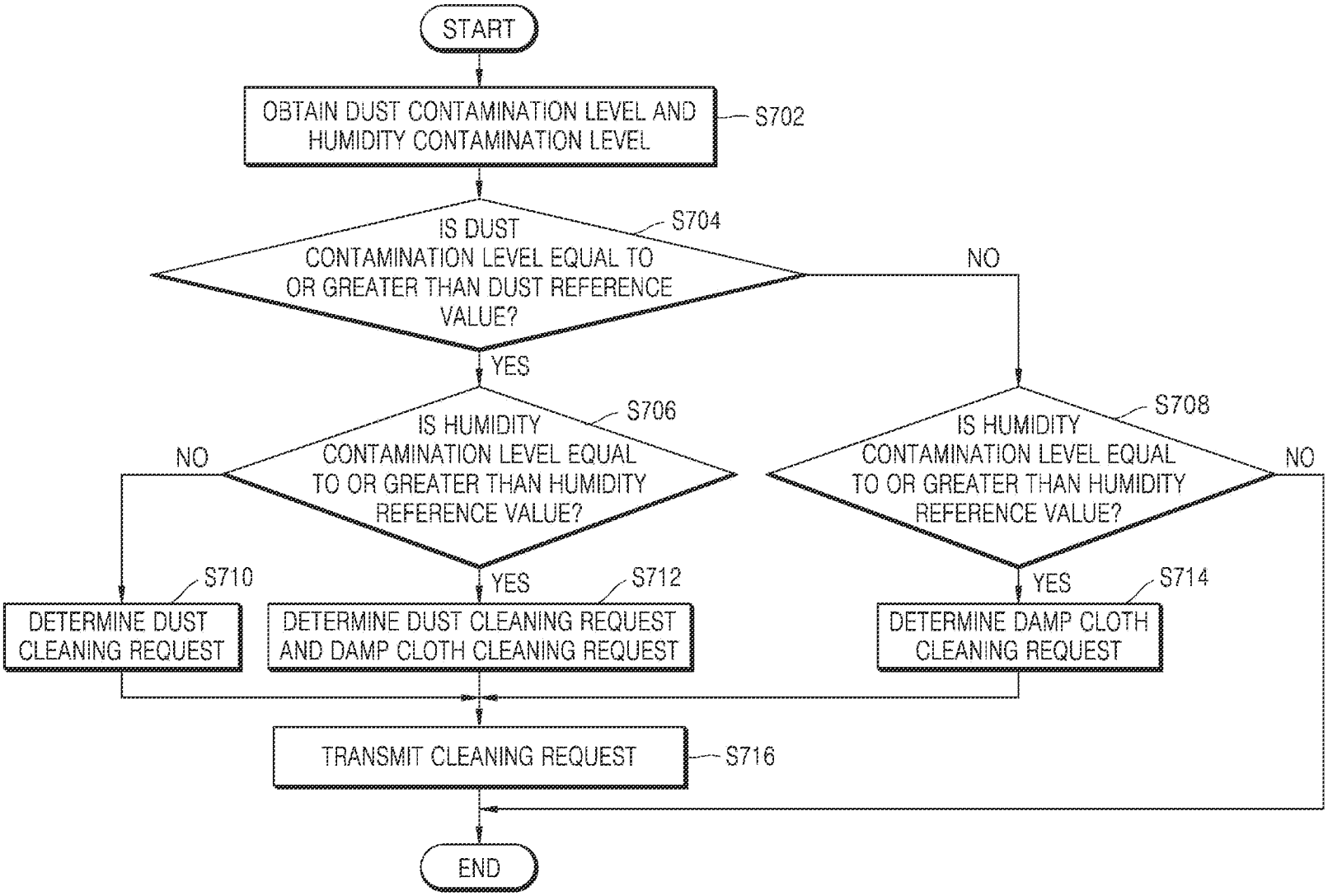
FIG. 7 is a diagram illustrating a method of controlling a shoe care device, according to an embodiment of the disclosure.

FIG. 7 is a diagram illustrating a method of controlling a shoe care device according to an embodiment of the disclosure.

According to an embodiment of the disclosure, the shoe care device 100 performs dust cleaning or damp cloth cleaning based on dust contamination level information and humidity contamination level information.

According to an embodiment of the disclosure, the shoe care device 100 may communicate with the plurality of robotic vacuum cleaners 110. The plurality of robotic vacuum cleaners 110 may include a damp cloth robotic vacuum cleaner and a vacuum robotic vacuum cleaner. The shoe care device 100 may transmit a cleaning request to a damp cloth robotic vacuum cleaner when requesting damp cloth cleaning, and may transmit a cleaning request to a vacuum robotic vacuum cleaner when requesting dust cleaning According to an embodiment of the disclosure, the robotic vacuum cleaner 110 may include a vacuum dust cleaning function and a damp cloth cleaning function. The shoe care device 100 may request dust cleaning or damp cloth cleaning when making the cleaning request. The robotic vacuum cleaner 110 performs dust cleaning when receiving a cleaning request requesting dust cleaning, and performs damp cloth cleaning when receiving a cleaning request requesting damp cloth cleaning.

Referring to FIG. 7, first, in operation S702, the shoe care device 100 obtains dust contamination level information and humidity contamination level information. The shoe care device 100 obtains dust contamination level information by using the dust sensor 362. In addition, the shoe care device 100 obtains humidity contamination level information by using the humidity sensor 364.

Next, the shoe care device 100 performs dust cleaning or humidity cleaning based on the dust contamination level information and the humidity contamination level information. FIG. 7 illustrates that the shoe care device 100 determines whether to perform dust cleaning or humidity cleaning through operations S704, S706, and S708, but this is exemplary, and the shoe care device 100 may determine whether to perform dust cleaning or humidity cleaning based on the dust contamination level information and the humidity contamination level information by various processing flows.

In operation S704, when the dust contamination level information is equal to or greater than a dust reference value, in operation S706, the shoe care device 100 determines whether the humidity contamination level information is equal to or greater than a humidity reference value. When the dust contamination level is greater than or equal to the dust reference value and the humidity contamination level is less than the humidity reference value, in operation S710, the shoe care device 100 determines to request dust cleaning Also, in operation S710, the shoe care device 100 generates a cleaning request requesting dust cleaning When the dust contamination level is equal to or greater than the dust reference value and the humidity contamination level is greater than or equal to the humidity reference value, the shoe care device 100 determines to request dust cleaning and damp cloth cleaning in operation S712. In addition, in operation S712, the shoe care device 100 generates a cleaning request requesting dust cleaning and damp cloth cleaning.

In operation S704, when the dust contamination level information is less than the dust reference value, in operation S708, the shoe care device 100 determines whether the humidity contamination level information is equal to or greater than the humidity reference value. When the dust contamination level information is less than the dust reference value and the humidity contamination level information is greater than or equal to the humidity reference value, in operation S714, the shoe care device 100 determines to request damp cloth cleaning In addition, in operation S714, the shoe care device 100 generates a cleaning request requesting damp cloth cleaning. When the dust contamination level information is less than the dust reference value and the humidity contamination level information is less than the humidity reference value, the shoe care device 100 ends processing without transmitting a cleaning request.

Next, in operation S716, the shoe care device 100 transmits a cleaning request to the robotic vacuum cleaner 110. The shoe care device 100 transmits a cleaning request requesting at least one of damp cloth cleaning or dust cleaning to the server 120. When the damp cloth robotic vacuum cleaner and the vacuum robotic vacuum cleaner are separately provided, the server 120 transmits a cleaning request requesting damp cloth cleaning to the damp cloth robotic vacuum cleaner, and transmits a cleaning request requesting vacuum cleaning to the vacuum robotic vacuum cleaner. When the server 120 includes the robotic vacuum cleaner 110 that performs both damp cloth cleaning and vacuum cleaning, the server 120 transmits a cleaning request requesting damp cloth cleaning or dust cleaning to the robotic vacuum cleaner 110. The robotic vacuum cleaner 110 performs either one of damp cloth cleaning or vacuum cleaning, or performs damp cloth cleaning and vacuum cleaning together based on a cleaning request.

Figure 8:
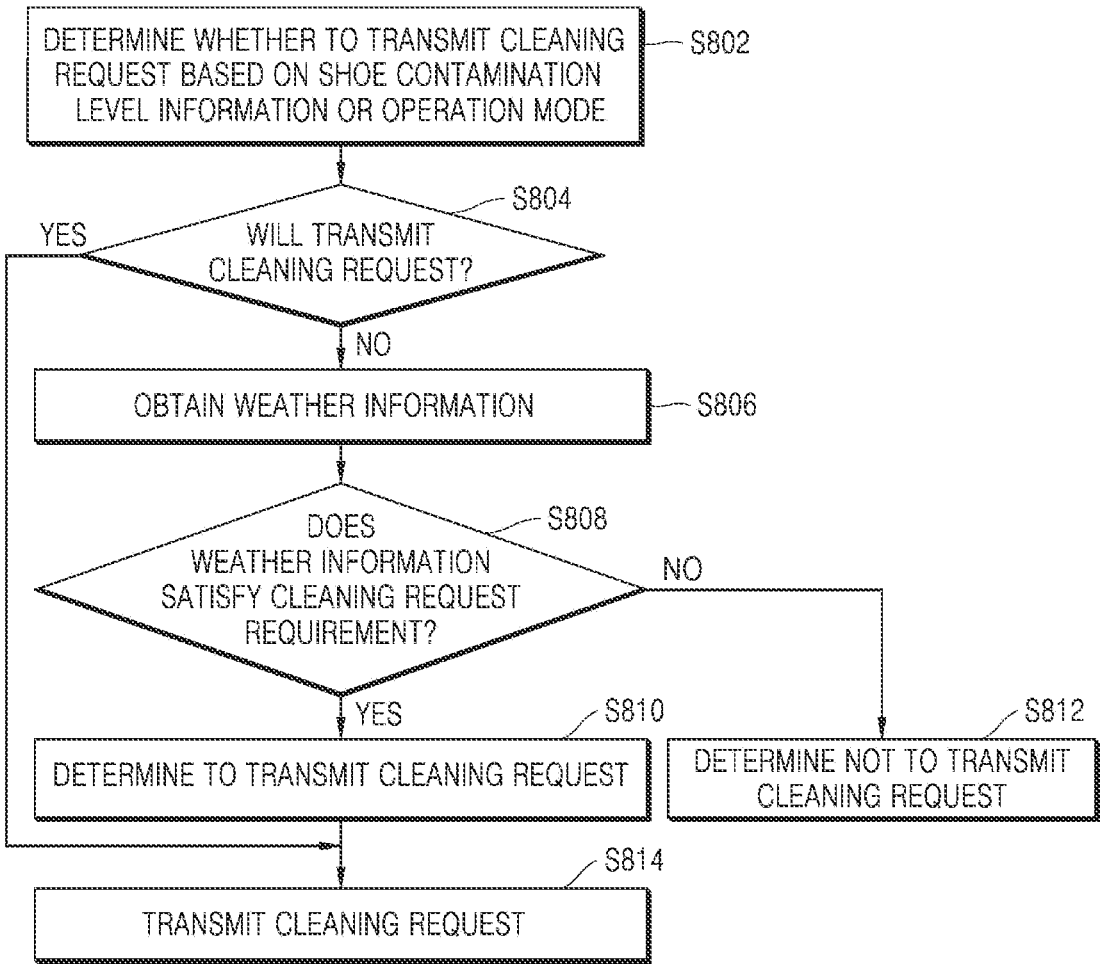
FIG. 8 is a diagram illustrating a process of determining whether to transmit a cleaning request, according to an embodiment of the disclosure.

FIG. 8 is a diagram illustrating a process of determining whether to transmit a cleaning request according to an embodiment of the disclosure.

According to an embodiment of the disclosure, when determining not to transmit the cleaning request based on shoe contamination level information or an operation mode, the shoe care device 100 may further determine whether to transmit the cleaning request based on weather information.

Referring to FIG. 8, first, in operation S802, the shoe care device 100 determines whether to transmit a cleaning request based on the shoe contamination level information or the operation mode.

In operation S804, when determining transmit the cleaning request, the shoe care device 100 transmits the cleaning request in operation S814.

In operation S804, when determining not to transmit the cleaning request, the shoe care device 100 proceeds to operation S806. In operation S806, the shoe care device 100 obtains weather information. According to an embodiment of the disclosure, the shoe care device 100 may obtain weather information from the server 120. According to an embodiment of the disclosure, the shoe care device 100 may obtain weather information from an open application program interface (API) that provides weather information.

The weather information includes local information, weather values according to time slots, or fine dust information. The weather values may include values such as rain, snow, sunny, cloudy, fog, etc. The shoe care device 100 obtains weather information of a date in an area where the shoe care device 100 is installed. For example, when the shoe care device 100 is installed in Gangnam-gu, Seoul, Korea, the shoe care device 100 obtains weather information of Gangnam-gu, Seoul, Korea. In addition, the shoe care device 100 obtains weather information of a section a certain time before the current time. For example, the shoe care device 100 obtains weather information 5 hours before the current time. For example, when the current time is 3 pm, the shoe care device 100 obtains weather information from 10 am to 3 pm.

Next, in operation S808, the shoe care device 100 determines whether the weather information satisfies a cleaning request requirement. For example, a cleaning request requirement is defined as requesting damp cloth cleaning when the weather information includes rain or snow. As an example, the cleaning request requirement is defined as requesting dust cleaning when the weather information includes a fine dust value greater than or equal to a reference value.

When the weather information satisfies the cleaning request requirement, the shoe care device 100 determines to transmit the cleaning request in operation S810. When the weather information does not satisfy the cleaning request requirement, the shoe care device 100 determines not to transmit the cleaning request in operation S812.

When determining to transmit the cleaning request, the shoe care device 100 transmits the cleaning request to the robotic vacuum cleaner 110 in operation S814.

FIG. 9 is a diagram illustrating determination standards for determining whether to request cleaning based on an operation mode of a shoe care device according to an embodiment of the disclosure.

According to an embodiment of the disclosure, the shoe care device 100 determines whether to transmit a cleaning request to the robotic vacuum cleaner 110 based on the operation mode being performed. In addition, the shoe care device 100 determines whether to request dust cleaning or damp cloth cleaning based on the operation mode being performed.

Referring to FIG. 9, the operation mode may include, for example, a daily care mode, a pre-outing mode, a strong mode, a hiking shoes mode, a shoes mode, a golf shoes mode, a rain boots mode, a boots mode, or a wet sneakers mode. The shoe care device 100 stores a lookup table defining whether to transmit a cleaning request and a type of cleaning with respect to each mode in the first memory 220.

According to an embodiment of the disclosure, the lookup table of FIG. 9 may be previously stored in the first memory 220.

According to an embodiment of the disclosure, the shoe care device 100 provides a user interface for a user to select whether to request cleaning and a type of cleaning according to an operation mode. A user may select whether to request cleaning and a type of cleaning according to the operation mode through the user interface. The shoe care device 100 prepares or updates a lookup table that stores whether request cleaning and a type of cleaning according to an operation mode based on a selection of the user, and stores the lookup table in the first memory 220.

Figure 10:
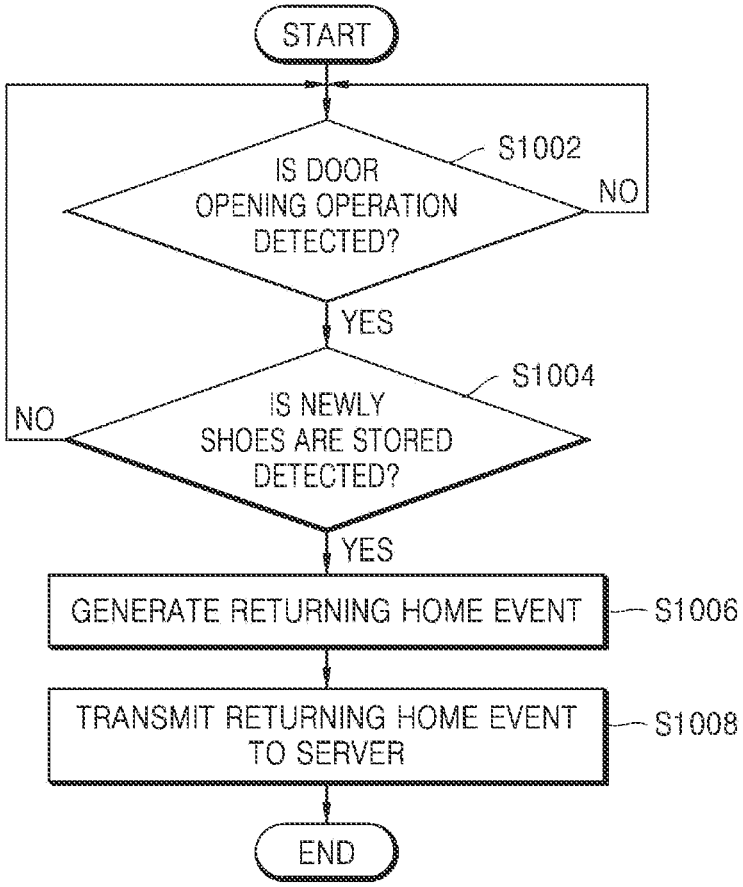
FIG. 10 is a diagram illustrating a process in which a shoe care device detects a returning home (or home returning) event, according to an embodiment of the disclosure.

FIG. 10 is a diagram illustrating a process in which a shoe care device detects a returning home event, according to an embodiment of the disclosure.

According to an embodiment of the disclosure, the shoe care device 100 detects a returning home event when a user returns home. The shoe care device 100 may control an operation of the robotic vacuum cleaner 110 based on detection of the returning home event.

Referring to FIG. 10, first, in operation S1002, the shoe care device 100 detects a door opening operation. The shoe care device 100 may include a door sensor detecting an open state and a closed state of the door 320. The door sensor is, for example, disposed near a hinge 323 to detect an open state and a closed state of the door 320.

When detecting the opening operation of the door 320, the shoe care device 100 detects whether new shoes are stored in operation S1004. The shoe care device 100 may include a shoe organizing sensor detecting a storage state of shoes of each rack 350. The shoe organizing sensor may be disposed, for example, near the rack 350. The shoe care device 100 may detect a storage state and a non-storage state of the shoes by using the shoe organizing sensor. When the shoe storage state of the at least one rack 350 is changed from the non-storage state to the storage state, the shoe care device 100 determines that new shoes are stored.

When determining that new shoes are not stored, the shoe care device 100 proceeds to operation S1002 of detecting the opening operation of the door 320 again.

When determining that new shoes are stored, the shoe care device 100 generates the home returning event in operation S1006. Next, in operation S1008, the shoe care device 100 transmits the home returning event to the server 120.

Figure 11:
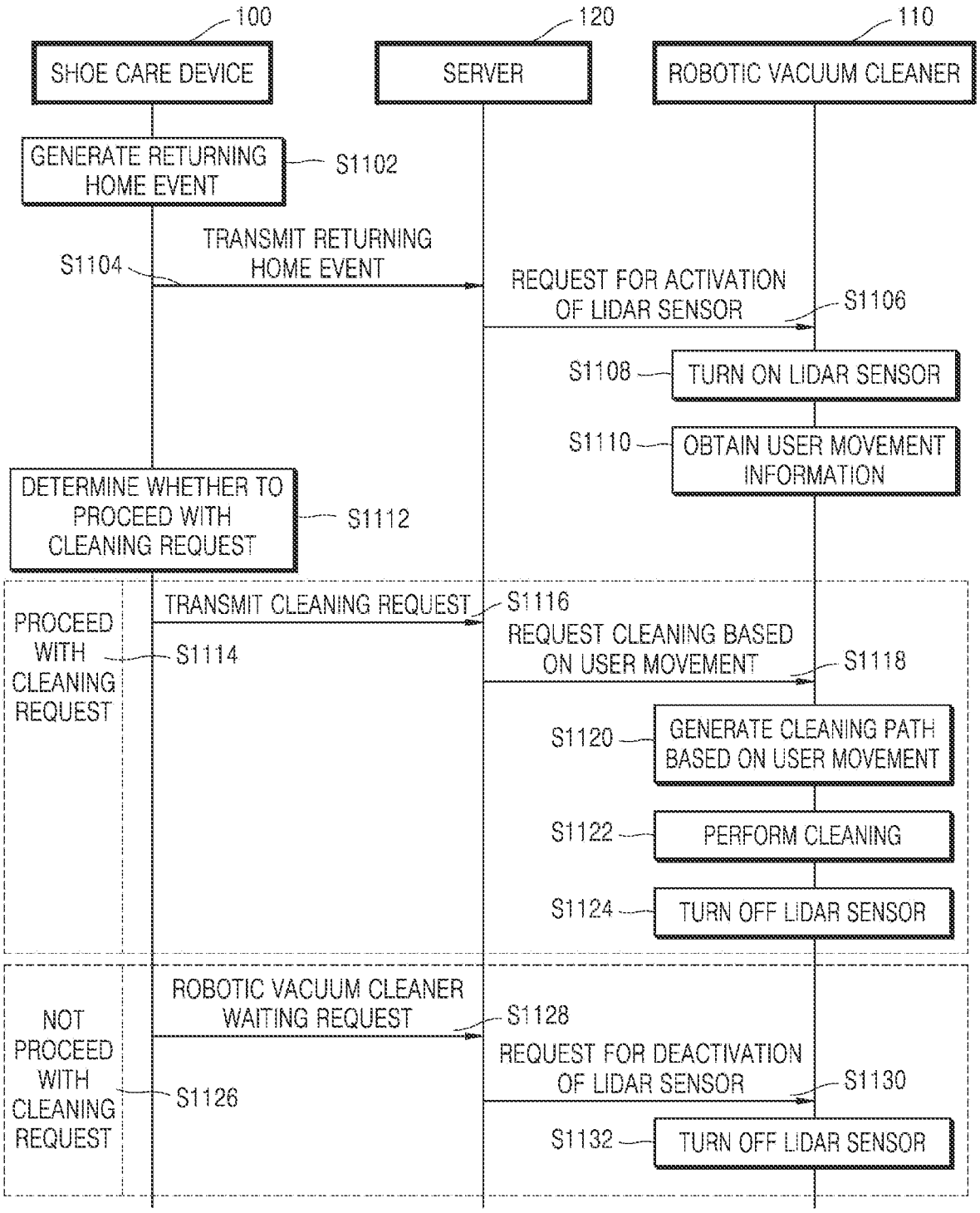
FIG. 11 is a diagram illustrating a process in which a shoe care device controls an operation of a robotic vacuum cleaner based on a home returning event, according to an embodiment of the disclosure.

FIG. 11 is a diagram illustrating a process in which a shoe care device controls an operation of a robotic vacuum cleaner based on a home returning event according to an embodiment of the disclosure.

Referring to FIG. 11, according to an embodiment of the disclosure, when the shoe care device 100 detects a home returning event, the server 120 may control the robotic vacuum cleaner 110 to obtain user movement information by using a lidar sensor of the robotic vacuum cleaner 110.

First, in operation S1102, the shoe care device 100 detects a home returning event. The shoe care device 100 may detect the home returning event as described above with reference to FIG. 10.

Next, in operation S1104, the shoe care device 100 transmits home returning event information to the server 120.

When receiving the home returning event information, the server 120 transmits a request for activation of the lidar sensor to the robotic vacuum cleaner 110 in operation S1106. The server 120 may include information about whether the at least one robotic vacuum cleaner 110 registered in an account in which the shoe care device 100 is registered includes a lidar sensor. The server 120 may determine whether the robotic vacuum cleaner 110 includes the lidar sensor when receiving the home returning event, and when the robotic vacuum cleaner 110 includes the lidar sensor, transmit the request for activation of the lidar sensor. When the robotic vacuum cleaner 110 does not include a lidar sensor, as will be described below with reference to FIG. 12, the server 120 may obtain the user movement information using a usage event of another IoT device.

When the robotic vacuum cleaner 110 receives the request for activation of the lidar sensor, the robotic vacuum cleaner 110 activates the lidar sensor in operation S1108. The robotic vacuum cleaner 110 obtains the user movement information by using the lidar sensor in operation S1110. When the robotic vacuum cleaner 110 turns on the lidar sensor based on the cleaning request received from the shoe care device 100 and initiates obtaining of the user movement information, the robotic vacuum cleaner 110 first moves near the shoe care device 100. The robotic vacuum cleaner 110 searches for a user using a detection value of the lidar sensor near the shoe care device 100. When detecting the user, the robotic vacuum cleaner 110 obtains the user movement information while tracking the user.

On the other hand, when detecting the home returning event, the shoe care device 100 determines whether to proceed with the cleaning request in operation S1112. The shoe care device 100 may determine whether to proceed with the cleaning request according to operation S506 of FIG. 5, and the embodiments of the disclosure described with reference to FIG. 7, 8, or 9 above.

When determining to proceed with the cleaning request, the shoe care device 100 operates in operation S1114, and when determining not to proceed with the cleaning request, the shoe care device 100 operates in operation S1126.

First, operation S1114, which is a case where the shoe care device 100 proceeds with a cleaning request, is described.

The shoe care device 100 transmits a cleaning request to the server 120 in operation S1116. When receiving the cleaning request, the server 120 transmits a cleaning request requesting cleaning based on the movement of the user to the robotic vacuum cleaner 110 in operation S1118.

When receiving the cleaning request from the server 120, in operation S1120, the robotic vacuum cleaner 110 generates a cleaning path based on the user movement information. Also, the robotic vacuum cleaner 110 performs cleaning based on the generated cleaning path in operation S1122. The robotic vacuum cleaner 110 may perform dust cleaning, damp cloth cleaning, or dust cleaning and damp cloth cleaning together based on the cleaning request.

According to an embodiment of the disclosure, the robotic vacuum cleaner 110 may simultaneously perform cleaning and obtain the user movement information in operation S1110. For example, the robotic vacuum cleaner 110 performs cleaning while tracking the user using the detection value of the lidar sensor.

According to an embodiment of the disclosure, the robotic vacuum cleaner 110 collects the user movement information while tracking the user in operation S1110. At this time, the robotic vacuum cleaner 110 does not perform cleaning. When determining that the user does not move for more than a certain time, the robotic vacuum cleaner 110 ends collection of the user movement information. When collection of the movement information ends, the robotic vacuum cleaner 110 generates a cleaning path based on the user movement information in operation S1120. The robotic vacuum cleaner 110 generates a cleaning path to include locations passed by the user and optimize a movement path of the robotic vacuum cleaner 110. Next, the robotic vacuum cleaner 110 performs cleaning based on the cleaning path generated in operation S1122.

Next, when cleaning ends, the robotic vacuum cleaner 110 turns off the lidar sensor in operation S1124.

Next, operation S1126, which is a case where the shoe care device 100 does not proceed with a cleaning request, is described.

First, in operation S1128, the shoe care device 100 transmits a robotic vacuum cleaner waiting request to the server 120. The robotic vacuum cleaner waiting request includes information that the cleaning request has been determined not to proceed.

When the server 120 receives the robotic vacuum cleaner waiting request, the server 120 transmits a request for deactivation of the lidar sensor to the robotic vacuum cleaner 110 in operation S1130. When the robotic vacuum cleaner 110 receives the request for deactivation of the lidar sensor, the robotic vacuum cleaner 110 turns off the lidar sensor in operation S1132.

Figure 12:
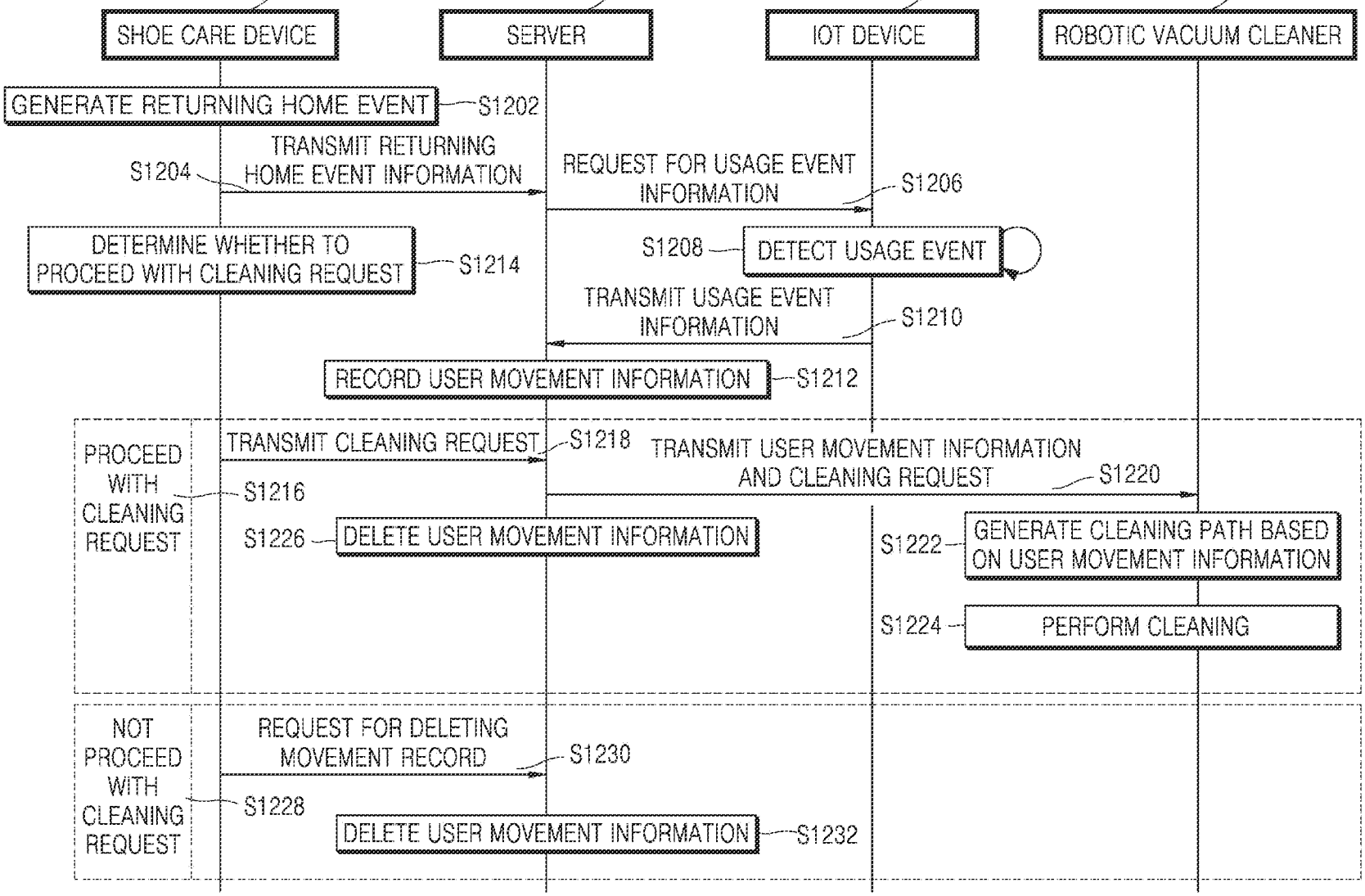
FIG. 12 is a diagram illustrating a process in which a shoe care device controls an operation of a robotic vacuum cleaner based on a home returning event, according to an embodiment of the disclosure.

FIG. 12 is a diagram illustrating a process in which a shoe care device controls an operation of a robotic vacuum cleaner based on a home returning event according to an embodiment of the disclosure.

Referring to FIG. 12, according to an embodiment of the disclosure, when the shoe care device 100 detects a home returning event, the server 120 obtains user movement information based on usage event information of a registered IoT device 1210. The robotic vacuum cleaner 110 receives the user movement information from the IoT device 1210, generates a cleaning path based on the received user movement information, and performs cleaning.

First, in operation S1202, the shoe care device 100 detects (or generates) a home returning event. The shoe care device 100 may detect the home returning event as described above with reference to FIG. 10.

Next, in operation S1204, the shoe care device 100 transmits home returning event information to the server 120.

Next, in operation S1206, when receiving the home returning event information, the server 120 transmits a request for the usage event information to the at least one IoT device 1210 registered in the server 120. When the home returning event information is received, the server 120 searches for the IoT device 1210 installed in an in-house space in which the shoe care device 100 is installed. The in-house space may correspond to a house, an office, a store, etc.

According to an embodiment of the disclosure, the server 120 searches for the IoT device 1210 that is registered in the user account in which the shoe care device 100 is registered, and is installed in the same in-house space as the shoe care device 10 among the registered IoT devices 1210. For example, it is assumed that the shoe care device 100, a first television (TV), a second TV, a first refrigerator, a second refrigerator, a first washing machine, and a second washing machine are registered in the user account. The shoe care device 100, the first TV, the first refrigerator, and the first washing machine are installed in the house, and the second TV, the second refrigerator, and the second washing machine are installed in the office. In this case, the server 120 transmits a request for usage event information to the first TV, the first refrigerator, and the first washing machine installed in the same space as the shoe care device 100, and may not request usage event information from the second TV, the second refrigerator, and the second washing machine.

According to an embodiment of the disclosure, the server 120 searches for all IoT devices 1210 installed in the in-house space in which the shoe care device 100 is installed. At this time, the server 120 searches for all the IoT device 1210 that communicates with the server 120 as well as the IoT device 1210 registered in the user account in which the shoe care device 100 is registered. For example, the server 120 may search for all the IoT devices 1210 installed in the in-house space, including the IoT devices 1210 registered in other user accounts. The server 120 may transmit a request for usage event information to the found IoT device 1210.

The request for usage event information is a message requesting the IoT device 1210 to collect and transmit information about usage event. The request for usage event information may include information such as a server address, user account information, authentication information, a type of a requested usage event, or an effective period of the request for usage event information.

In operation S1208, when receiving the request for usage event information, the IoT device 1210 detects the usage event when a usage event in which the user uses the IoT device 1210 occurs and generates usage event information. An operation in which the user uses the IoT device 1210 includes manipulation of a user interface of the IoT device 1210, opening/closing of a door, input of a voice command, physical manipulation of the IoT device 1210, etc. For example, the IoT device 1210 may detect a usage operation and detect a usage event using a sensor. As an example, the IoT device 1210 may detect a usage event based on a user input detected from a user interface, etc.

The usage event information includes identification information of the IoT device 1210, information indicating that a usage operation is detected, and time information at which the usage event is detected.

When a usage event is detected, the IoT device 1210 transmits usage event information to the server 120 in operation S1210.

When receiving the usage event information from the IoT device 1210, the server 120 records the user movement information based on the usage event information in operation S1212.

The server 120 may store location information of each IoT device 1210. For example, the server 120 stores the location information of each IoT device 120 such as the first TV in the living room, the first washing machine in the utility room, and the first refrigerator in the kitchen. For example, the server 120 may store location information of each IoT device 120 in advance. As an example, the usage event information may include location information of the IoT device 1210, and the server 120 may obtain location information of the IoT device 120 based on the location information included in the usage event information.

In addition, the usage event information includes time information at which the usage event occurred. The server 120 records the movement of the user based on the time when the usage event occurred and the location information of each IoT device 120.

On the other hand, when detecting a home returning event, the shoe care device 100 determines whether to proceed with the cleaning request in operation S1214. The shoe care device 100 may determine whether to proceed with the cleaning request according to operation S506 of FIG. 5 and the embodiments described with reference to FIG. 7, 8, or 9 above.

When determining to proceed with the cleaning request, the shoe care device 100 operates in operation S1216, and when determining not to proceed with the cleaning request, the shoe care device 100 operates in operation S1228.

First, operation S1216, which is a case where the shoe care device 100 proceeds with a cleaning request, is described.

The shoe care device 100 transmits a cleaning request to the server 120 in operation S1218. When receiving the cleaning request, the server 120 transmits the user movement information and the cleaning request to the robotic vacuum cleaner 110 in operation S1220.

When receiving the user movement information and the cleaning request from the server 120, in operation S1222, the robotic vacuum cleaner 110 generates a cleaning path based on the user movement information. Also, the robotic vacuum cleaner 110 performs cleaning based on the generated cleaning path in operation S1224. The robotic vacuum cleaner 110 may perform dust cleaning, damp cloth cleaning, or dust cleaning and damp cloth cleaning together based on the cleaning request.

In operation S1226, the server 120 deletes the user movement information after transmitting the user movement information and the cleaning request to the robotic vacuum cleaner 110. According to an embodiment of the disclosure, for personal information protection, the user movement information recorded based on a usage event of the IoT device 1210 may be deleted from the server 120 when completely transmitted to the robotic vacuum cleaner 110. The server 120 records the user movement information in a certain memory or database, and deletes the user movement information in operation S1226.

Next, operation S1228, which is a case where the shoe care device 100 does not proceed with a cleaning request, is described.

First, in operation S1230, the shoe care device 100 transmits a request for deleting a movement record to the server 120.

When receiving the request for deleting the movement record, the server 120 deletes the user movement information in operation S1232.

Figure 13:
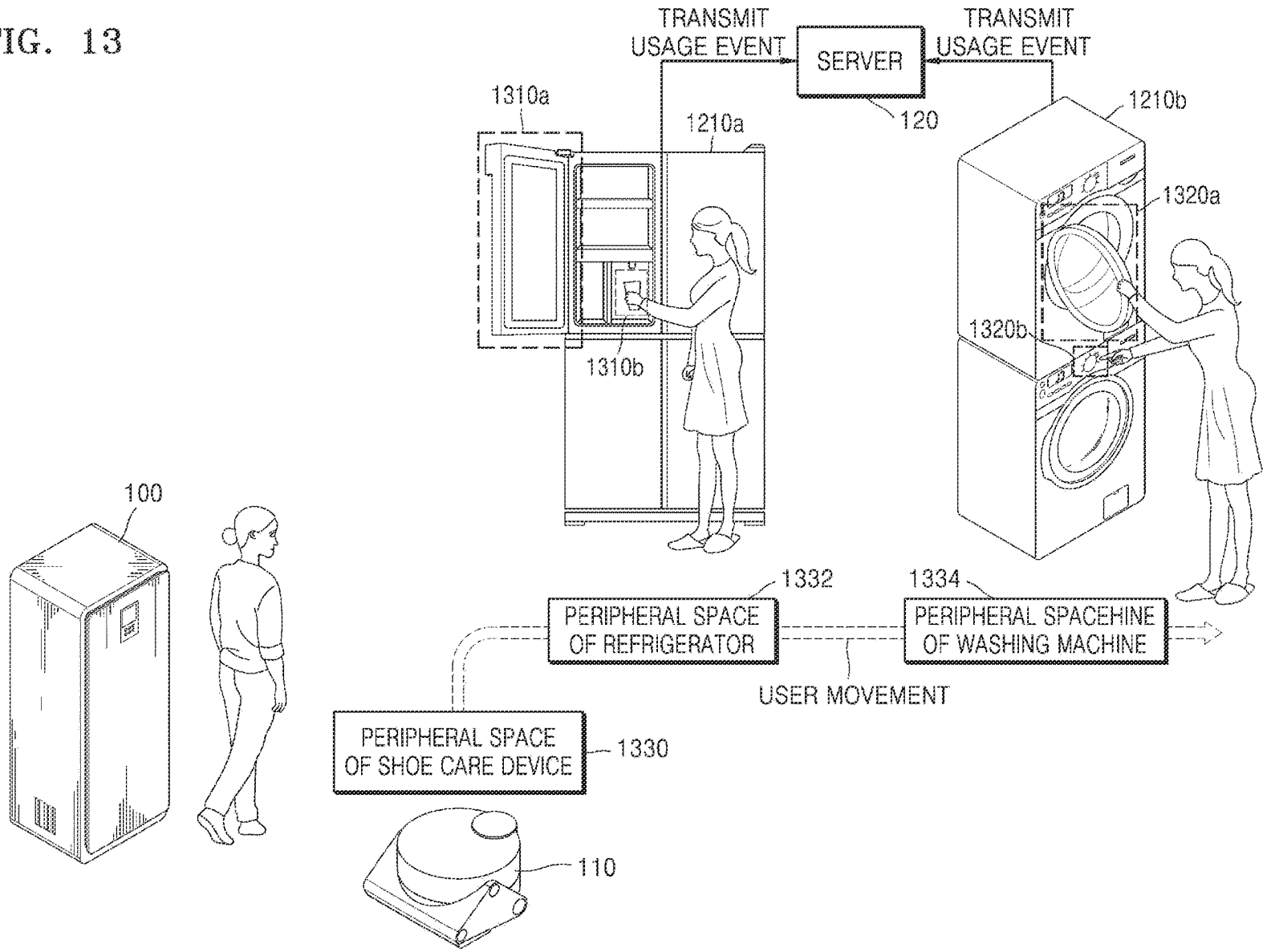
FIG. 13 is a diagram illustrating a process of recording user movement information and performing cleaning, according to an embodiment of the disclosure.

FIG. 13 is a diagram illustrating a process of recording user movement information and performing cleaning according to an embodiment of the disclosure.

Referring to FIG. 13, according to an embodiment of the disclosure, the user movement information is recorded based on usage events of IoT devices 1210*a* and 1210*b*. The IoT devices 1210*a* and 1210*b* are electronic devices disposed in an in-house space and registered in the server 120. FIG. 13 illustrates an example in which the IoT devices 1210*a* and 1210*b* include a refrigerator 1210*a* and a washing machine 1210*b*. The IoT devices 1210*a* and 1210*b* are not limited to examples illustrated in FIG. 13, and may include various types of home appliances. The IoT devices 1210*a* and 1210*b* may include, for example, various types of home appliances such as TV, refrigerators, washing machines, dryers, inductions, ovens, air conditioners, clothing care devices, air purifiers, speakers, etc.

When detecting an opening or closing operation of a door 1310*a* or a manipulation operation of a lever of a water purifier 1310*b*, the refrigerator 1210*a* generates a usage event. The refrigerator 1210*a* transmits usage event information to the server 120. The refrigerator 1210*a* may be installed in the kitchen. The refrigerator 1210*a* may be connected to an AP device and communicate with the server 120 through the AP device.

When detecting an opening or closing operation of a door 1320*a* or a manipulation operation of a button 1320*b*, the washing machine 1210*b* generates a usage event. The washing machine 1210*b* transmits usage event information to the server 120. The washing machine 1210*b* may be installed in the utility room. The washing machine 1210*b* may be connected to the AP device and communicate with the server 120 through the AP device.

The shoe care device 100 may be installed in an entrance hall.

In the example of FIG. 13, the user may move in the order of the shoe care device 100, the refrigerator 1210*a*, and the washing machine 1210*b*.

The server 120 generates the user movement information according to a time order in which the usage event is detected.

According to an embodiment of the disclosure, the server 120 may generate the user movement information indicating that the user has moved in the order of a peripheral space 1330 of the shoe care device 100, a peripheral space 1332 of the refrigerator 1210*a*, and a peripheral space 1334 of the washing machine 1210*b*.

According to an embodiment of the disclosure, a range of each of the peripheral spaces 1330, 1332, and 1334 of the respective devices may be defined as an area in which the device is installed. For example, the peripheral space 1330 of the shoe care device 100 may be defined as the entrance hall, the peripheral space 1332 of the refrigerator 1210*a* may be defined as the kitchen, and the peripheral space 1334 of the washing machine 1210*b* may be defined as the utility room.

According to an embodiment of the disclosure, the range of the surrounding spaces 1330, 1332, and 1334 of each device may be defined as an area including a certain distance from the corresponding device. For example, the range of each of the peripheral spaces 1330, 1332, and 1334 of the respective devices may be defined as an area up to 1 m from the edge of the device.

The robotic vacuum cleaner 110 sets a cleaning path based on the user movement information. The robotic vacuum cleaner 110 sets a cleaning path including the user movement information and efficiently performing cleaning. Therefore, the order in which the robotic vacuum cleaner 110 moves in the cleaning path of the robotic vacuum cleaner 110 may not coincide with the order in which the user moves in the user movement information. For example, the user has moved in the order of the shoe care device 100, the refrigerator 1210*a*, and the washing machine 1210*b*, but the cleaning path may be set in the order of the refrigerator 1210*a*, the shoe care device 100, and the washing machine 1210*b*.

Figure 14:
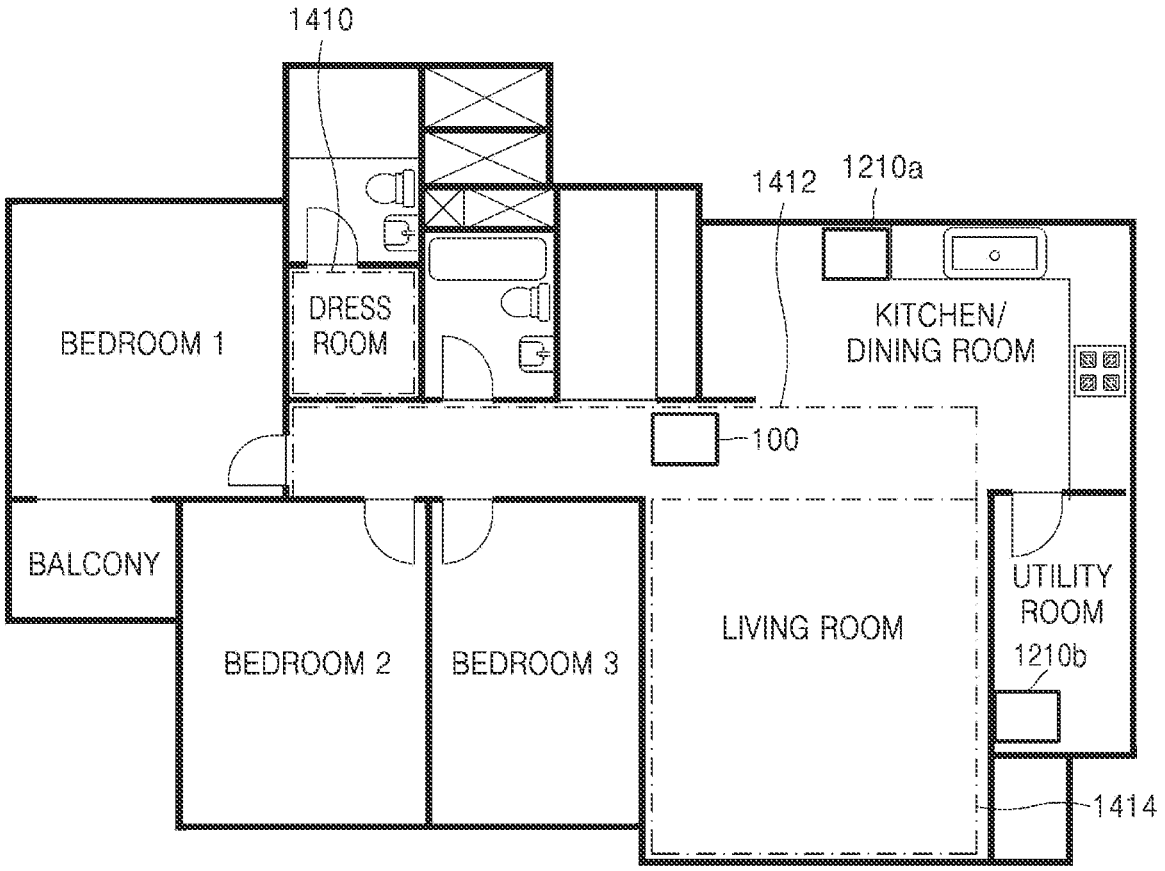
FIG. 14 is a diagram illustrating a process of setting a cleaning path, according to an embodiment of the disclosure.

FIG. 14 is a diagram illustrating a process of setting a cleaning path according to an embodiment of the disclosure.

According to an embodiment of the disclosure, when the shoe care device 100 or the server 120 detects a returning home event but does not identify movement, of a user, a previously determined area may be set as a cleaning area.

When the robotic vacuum cleaner 110 does not include a lidar sensor, the robotic vacuum cleaner 110 may not identify the movement of the user. Also, when the IoT device 1210 installed in an in-house space is not registered in the server 120, the server 120 may not obtain user movement information based on a usage event of the IoT device 1210. In addition, when the user does not allow obtaining of the user movement information, the robotic vacuum cleaner 110 or the server 120 may not obtain the user movement information.

Referring to FIG. 14, according to an embodiment of the disclosure, the previously determined area may be predefined as a certain area of the in-house space and stored in the server 120 or the robotic vacuum cleaner 110. The previously determined area may be defined as an area that the user is likely to pass through after returning home. For example, the previously determined area may be defined as a hallway 1412, a dressing room 1410, and a living room 1414.

According to an embodiment of the disclosure, the previously determined area may be designated by a user. The user may use an IoT application provided through a mobile device to previously designate an area to be cleaned by the robotic vacuum cleaner 110 when a home returning event occurs. The server 120 or the robotic vacuum cleaner 110 may define and store the area designated by the user as the previously determined area.

According to an embodiment of the disclosure, the previously determined area may correspond to the entire area of the in-house space. When the in-house space includes a first bedroom 1, a second bedroom 2, a third bedroom 3, a dress room (e.g., a dressing room, walk-in closet, etc.), a living room, a kitchen/dining room, and a utility room and may not obtain the user movement information, the server 120 or the robotic vacuum cleaner 110 may set all areas accessible to the cleaner 110 in the in-house space, i.e., the first bedroom 1, the second bedroom 2, the third bedroom 3, the dressing room, the living room, and the kitchen/dining room, as the cleaning area. Because the utility room is not accessible to the robotic vacuum cleaner 110, the utility room may be excluded from the cleaning area.

Figure 15:
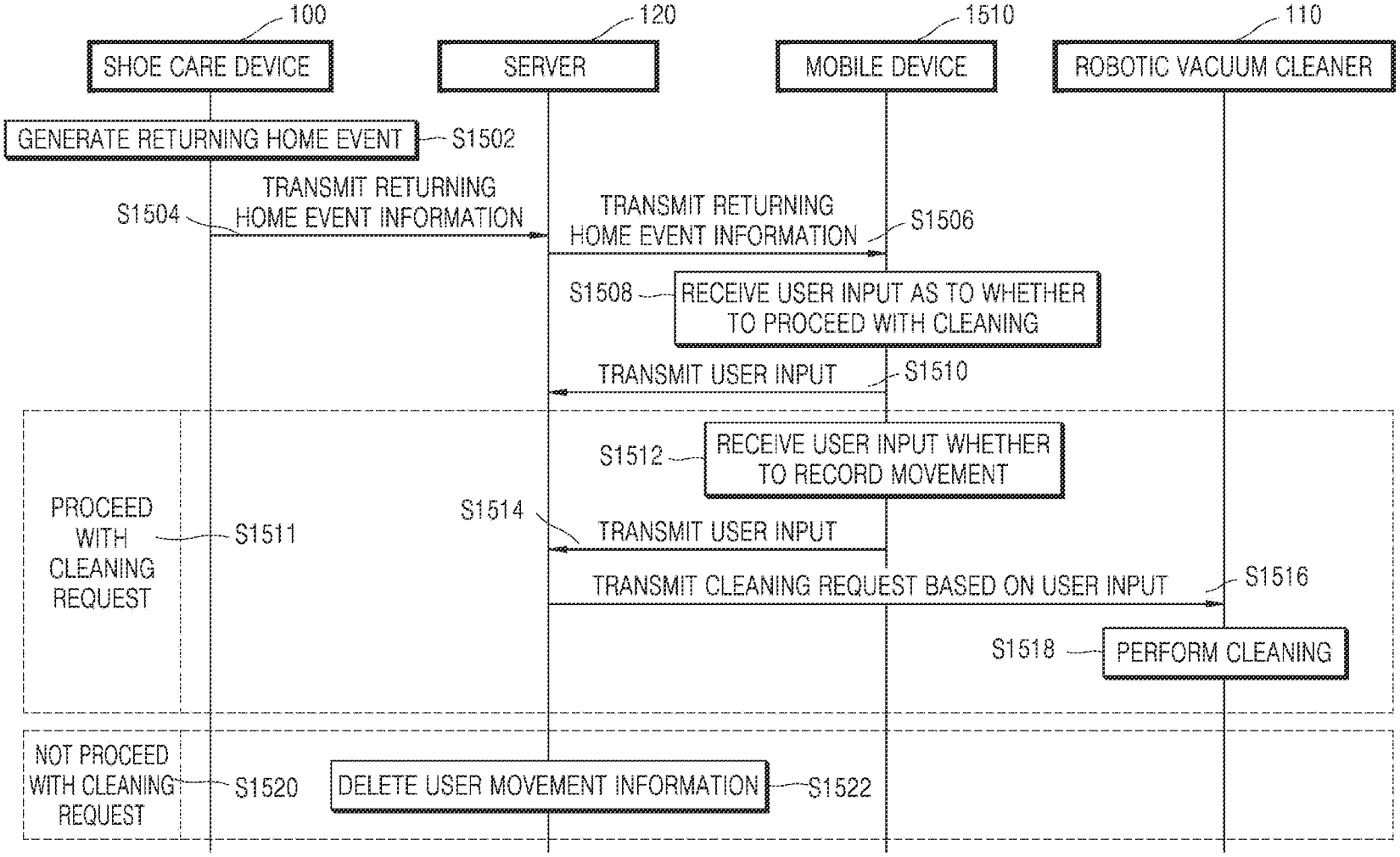
FIG. 15 is a diagram illustrating a process in which a mobile device controls a cleaning operation of a robotic vacuum cleaner, according to an embodiment of the disclosure.

FIG. 15 is a diagram illustrating a process in which a mobile device controls a cleaning operation of a robotic vacuum cleaner according to an embodiment of the disclosure.

Referring to FIG. 15, according to an embodiment of the disclosure, a mobile device 1510 is registered in the server 120 and receives a user input for controlling the cleaning operation of the robotic vacuum cleaner 110 through an IoT application installed in the mobile device 1510.

The mobile device 1510 may be a device that accesses the server 120 with the same user account as the shoe care device 100. The mobile device 1510 may correspond to, for example, a smart phone, a wearable device, a tablet PC, a laptop computer, etc. The mobile device 1510 may install and execute an IoT application having a function of controlling the shoe care device 100 and the robotic vacuum cleaner 110 registered in the server 120. The mobile device 1510 may provide state information of the shoe care device 100 or the robotic vacuum cleaner 110 through the IoT application. Also, the mobile device 1510 may receive a user input for controlling the shoe care device 100 or the robotic vacuum cleaner 110 through the IoT application.

First, in operation S1502, the shoe care device 100 detects a home returning event. The shoe care device 100 may detect a home returning event as described above with reference to FIG. 10.

Next, in operation S1504, the shoe care device 100 transmits home returning event information to the server 120.

When receiving the home returning event information, in operation S1506, the server 120 transmits the home returning event information to the mobile device 1510. When receiving the home returning event information, in operation S1508, the mobile device 1510 receives a user input as to whether to proceed with cleaning. When receiving the home returning event information, the mobile device 1510 executes the IoT application or provides a notification through the IoT application. The mobile device 1510 may provide a GUI menu for receiving a user input as to whether to proceed with cleaning through the IoT application. The mobile device 1510 receives a user input that selects whether to proceed with cleaning through the IoT application.

Figure 16:
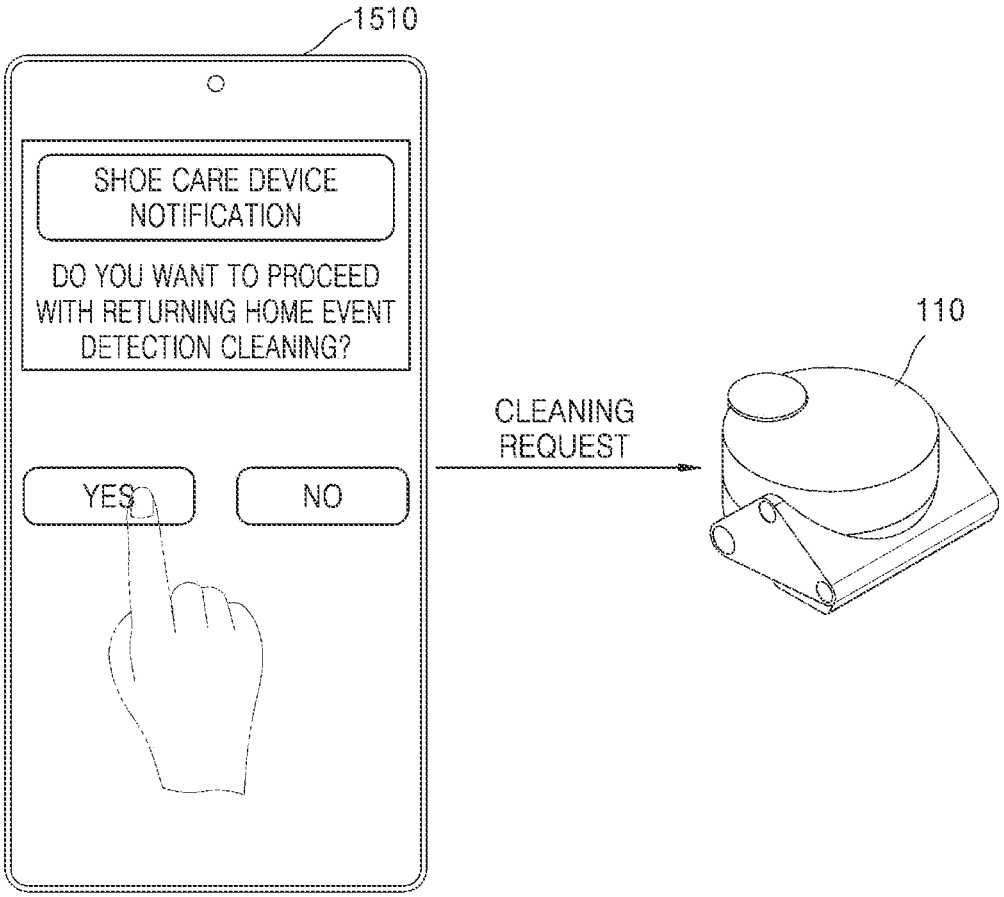
FIG. 16 is a diagram illustrating a process in which a mobile device selects whether to proceed with cleaning based on detection of a home returning event, according to an embodiment of the disclosure.

FIG. 16 is a diagram illustrating a process in which a mobile device selects whether to proceed with cleaning based on detection of a home returning event according to an embodiment of the disclosure. The operation of FIG. 15 is described with reference to FIG. 16.

Referring to FIG. 16, according to an embodiment of the disclosure, when receiving home returning event information from the server 120, the mobile device 1510 may inquire about whether to proceed with cleaning through an IoT application. The IoT application provides information that a notification has occurred from a shoe care device and that a home returning event has been detected. In addition, the IoT application provides a GUI element for selecting whether to proceed with cleaning When receiving a user input as to whether to proceed with cleaning, the mobile device 1510 transmits the received user input to the server 120 in operation S1510. When receiving a user input requesting to proceed with cleaning from the mobile device 1510, operation S1511 is performed. When receiving a user input requesting not to proceed with cleaning from the mobile device 1510, operation S1520 is performed.

Referring to FIG. 15, first, operation S1511, which is a case in which a user input requesting to proceed with cleaning is received, is described. When a user requests to perform cleaning, the mobile device 1510 receives a user input for selecting whether to record a movement in operation S1512. The mobile device 1510 may receive a user input as to whether to record the movement through the IoT application. Recording of the movement is obtained by using a lidar sensor of the robotic vacuum cleaner 110 or using event information of the IoT device 120 registered in the server 120.

When receiving a user input as to whether to record the movement, the mobile device 1510 transmits a user input as to whether to record the movement to the server 120 in operation S1514. The server 120 transmits a cleaning request to the robotic vacuum cleaner 110 based on the user input as to whether to record the movement in operation S1516. Also, the robotic vacuum cleaner 110 performs cleaning based on the generated cleaning path in operation S1518.

When the user selects to record the user movement and perform a cleaning operation based on the user movement, the server 120 performs processing for obtaining user movement information. According to an embodiment of the disclosure, the server 120 requests activation of the lidar sensor from the robotic vacuum cleaner 110. The robotic vacuum cleaner 110 generates user movement information using a detection value of the lidar sensor. According to an embodiment of the disclosure, the server 120 requests usage event information from the IoT device 1210. The server 120 records the user movement information based on the usage event information of the IoT device 1210. The server 120 transmits the user movement information to the robotic vacuum cleaner 110.

When the user requests to perform cleaning without recording the user movement, the server 120 does not perform processing for obtaining the user movement information, and transmits a cleaning request requesting cleaning of a previously determined area to the robotic vacuum cleaner 110. In this case, the server 120 does not request activation of the lidar sensor from the robotic vacuum cleaner 110. Also, in this case, the server 120 does not request the usage event information from the IoT device 1210 and does not record the user movement information. When the server 120 starts recording the user movement information, the server 120 deletes the user movement information.

Next, operation S1520 corresponding to a case where the user requests not to proceed with cleaning is described.

When the user requests not to proceed with cleaning, the server 120 does not transmit the cleaning request to the robotic vacuum cleaner 110. When the server 120 receives the usage event information from the IoT device 1210 in response to a home returning event and starts generating the user movement information, the server 120 deletes the user movement information in operation S1522 based on a user input requesting not to proceed with cleaning.

Figure 17:
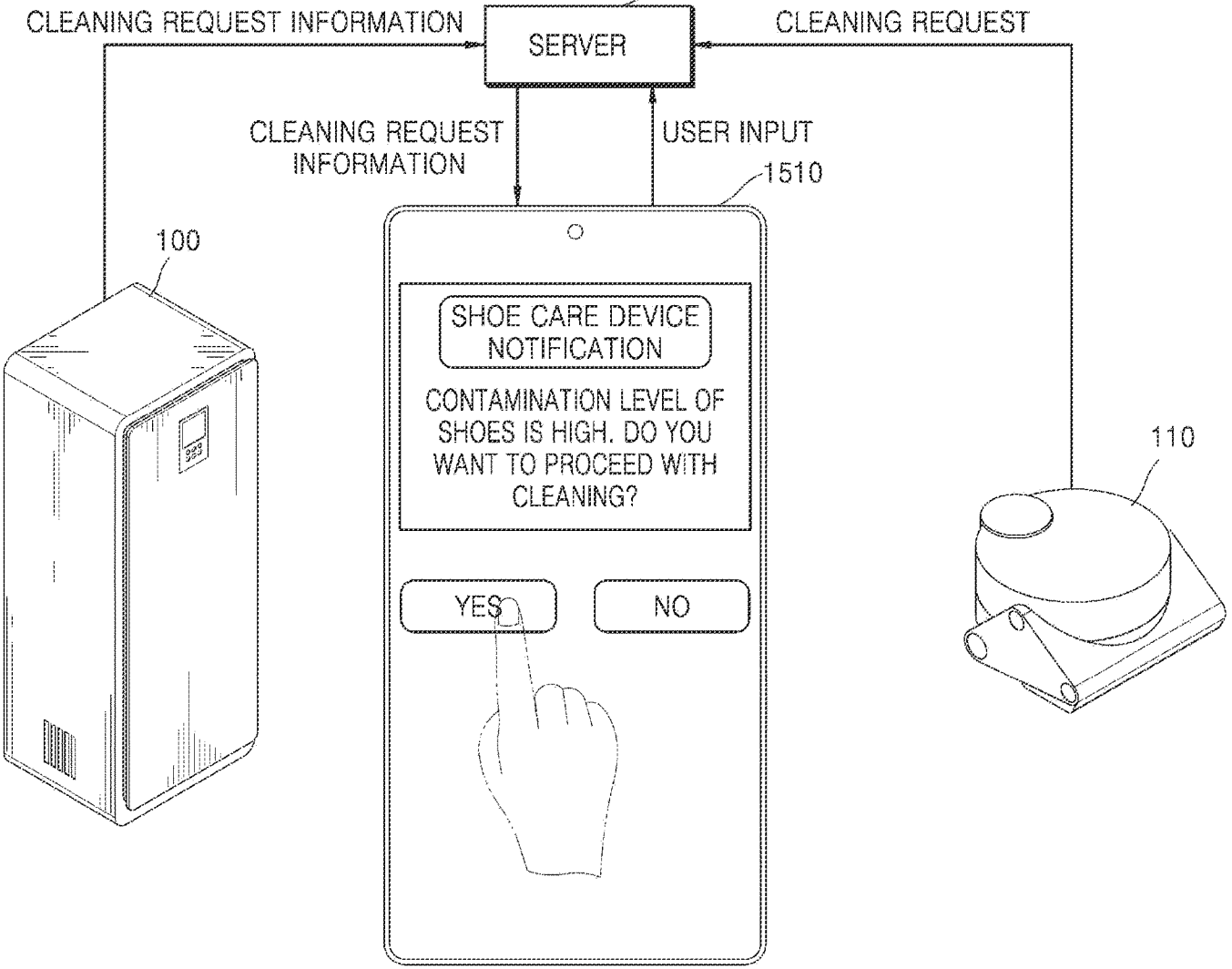
FIG. 17 is a diagram illustrating a process in which a mobile device controls a process of performing cleaning based on shoe contamination level information, according to an embodiment of the disclosure.

FIG. 17 is a diagram illustrating a process in which a mobile device controls a process of performing cleaning based on shoe contamination level information according to an embodiment of the disclosure.

Referring to FIG. 17, according to an embodiment of the disclosure, when the shoe care device 100 determines to proceed with a cleaning request based on the shoe contamination level information or an operation mode being performed, a user may determine whether to proceed with the cleaning request through the mobile device 1510.

According to an embodiment of the disclosure, the shoe care device 100 determines to proceed with the cleaning request when the shoe contamination level information exceeds a reference value. According to an embodiment of the disclosure, the shoe care device 100 determines to proceed with the cleaning request based on the operation mode being performed. At this time, the shoe care device 100 transmits information indicating that cleaning is requested because the shoe contamination level information exceeds the reference value to the robotic vacuum cleaner 110 or information indicating that cleaning is requested based on the operation mode to the server 120. The server 120 transmits the cleaning request information received from the shoe care device 100 to the mobile device 1510. Based on the cleaning request information received from the shoe care device 100, the mobile device 1510 inquires of the user whether to proceed with cleaning through a user interface. When receiving the cleaning request information, the mobile device 1510 may output a GUI element capable of providing the cleaning request information and receiving a user input through an IoT application. When receiving the user input, the mobile device 1510 transmits the user input to the server 120.

The server 120 determines whether to transmit the cleaning request based on the user input. When the user selects to proceed with cleaning, the server 120 transmits a cleaning request to the robotic vacuum cleaner 110. The server 120 does not transmit a cleaning request to the robotic vacuum cleaner 110 when the user selects not to proceed with cleaning.

Figure 18:
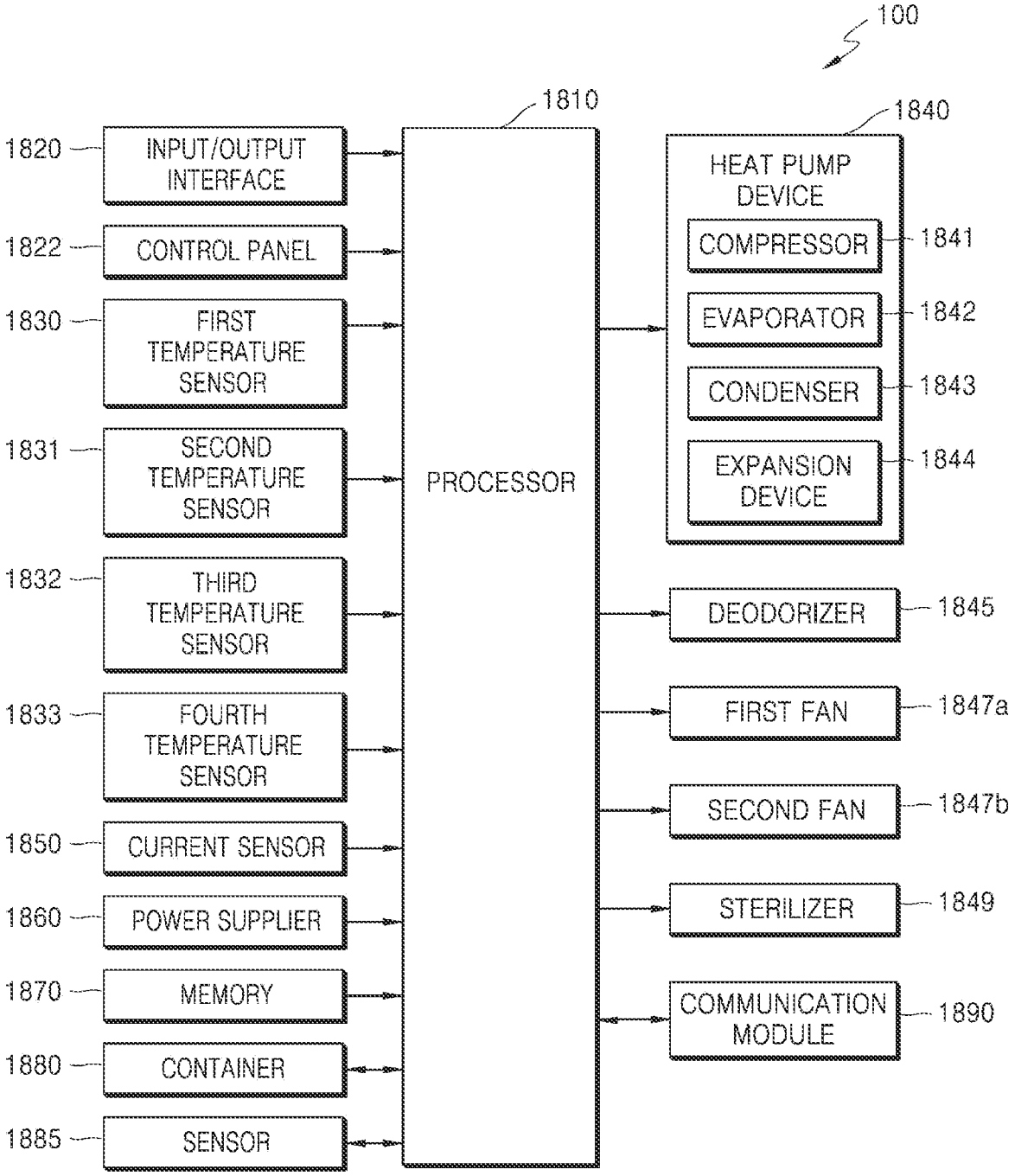
FIG. 18 is a diagram illustrating a structure of a shoe care device according to an embodiment of the disclosure.

FIG. 18 is a diagram illustrating a structure of a shoe care device according to an embodiment of the disclosure.

Referring to FIG. 18, the shoe care device 100 may include a processor 1810, an input/output interface 1820, a heat pump device 1840, a deodorizer 1845, a first fan 1847*a*, a second fan 1847*b*, a sterilizer 1849, a first temperature sensor 1830, a second temperature sensor 1831, a third temperature sensor 1832, a fourth temperature sensor 1833, a current sensor 1850, a power supplier 1860, a memory 1870, a container 1880, a sensor 1885, and a communication module 1890.

The processor 1810 of FIG. 18 corresponds to the first processor 210 of FIG. 2. The heat pump device 1840, the deodorizer 1845, the first fan 1847*a*, the second fan 1847*b*, the sterilizer 1849, the first temperature sensor 1830, the second temperature sensor 1831, the third temperature sensor 1832, the fourth temperature sensor 1833, and the current sensor 1850 correspond to the shoe care module 218 of FIG. 2. The memory 1870 corresponds to the first memory 220 of FIG. 2. The container 1880 corresponds to the container 214 of FIG. 2. The sensor 1885 corresponds to the sensor 216 of FIG. 2. The communication module 1890 corresponds to the first communication module 212 of FIG. 2.

The processor 1810 may be electrically connected to components of the shoe care device 100 described above, and may control an operation of each of the components.

The power supplier 1860 may supply power to the components of the shoe care device 100. The power supplier 1860 may be implemented as a printed circuit board and a power circuit mounted on the printed circuit board. For example, the power supplier 1860 may include a condenser, a coil, a resistance element, a processor, etc., and a power circuit board on which these are mounted.

The shoe care device 100 may include the memory 1870 recording and storing programs, instructions, and data used to control the operation of the shoe care device 100. Further, the shoe care device 100 may include the processor 1810 that generates a control signal for controlling the operation of the shoe care device 100 based on programs, instructions and data recorded and/or stored in the memory 1870. The processor 1810 and the memory 1870 may be implemented as one control circuit or a plurality of circuits.

The processor 1810 is hardware and may include a logic circuit and an arithmetic circuit. The processor 1810 may process data according to programs and/or instructions provided from the memory 1870, and generate a control signal according to a processing result. For example, when a user inputs a command by manipulating the input/output interface 1820, the processor 1810 processes the input command and controls each of the components of the shoe care device 100 to perform an operation corresponding to the input command.

The memory 1870 may include a volatile memory such as a static random access memory (S-RAM) and a dynamic random access memory (D-RAM) temporarily storing data, and a nonvolatile memory such as a read only memory (ROM), an erasable programmable read only memory (EPROM), and an electronically erasable programmable read only memory (EEPROM) storing data for a long period of time.

The input/output interface 1820 may be provided on an outer surface of a door or the shoe care device 100. The input/output interface 1820 may include an input interface such as a key, a touch screen, a touch pad, and control panel 1822. Also, the input/output interface 1820 may include an output interface such as a display or a speaker. The processor 1810 may determine a target temperature based on a selection signal of a type of shoes and a care course transmitted from the input/output interface 1820. In addition, the processor 1810 may determine an operating time of the shoe care device 100 based on the selected type of shoes and care course.

The user may select a type of shoes to be cared for by using the input/output interface 1820. For example, the input/output interface 1820 may provide at least one of a shoe type menu enabling selection of a type of shoes or a care course menu enabling selection of a care course. Types of shoes may include types according to a use or shape, such as shoes, sneakers, hiking boots, boots, sandals, rain boots, etc. In addition, the types of shoes may include types according to materials such as leather, cotton, nylon, mixed materials, silk, enamel, suede, neoprene, etc.

The processor 1810 may determine a target temperature of air to be supplied into the chamber 330 based on the type of shoes. Because shoes have different characteristics depending on their types, a target temperature for caring for the shoes may be set differently according to the characteristics of the shoes. For example, a low target temperature equal to or higher than 30° C. and less than 38° C. may be set for shoes made of a mixed material. An intermediate target temperature equal to or higher than 38° C. and less than 43° C. may be set for shoes made of leather. A high target temperature equal to or higher than 43° C. and less than 60° C. may be set for shoes made of cotton.

As an example, when two or more types of shoes are to be cared for or humidity exists in the shoes, a target temperature for dehumidification may be set to less than 40° C., and a target temperature for deodorization may be set to be equal to or higher than 40° C. and less than 60° C. Damage to the shoes may be prevented by setting such a target temperature. In addition, when both dehumidification and deodorization are required, deodorization may be performed after dehumidification. Damage to the shoes may be minimized by dehumidifying the shoes at a low temperature and then deodorizing the shoes at a high temperature.

In addition, the user may set an appropriate care course for the shoes by using the input/output interface 1820. The processor 1810 may determine the operating time of the shoe care device 100 based on the selected care course. For example, the care course may include at least one of a standard course, a rapid course, a strong course, or a clean storage course. The standard course is a basic care course, and may be defined as a care course in which the shoe care device 100 operates for a period of standard time (e.g., 30 minutes) for normally exhibiting a dehumidification effect and a deodorization effect. The rapid course may be defined as a care course in which the shoe care device 100 exhibits the minimum dehumidification effect and deodorization effect within a shorter time than the standard course. The strong course may be defined as a care course in which the shoe care device 100 operates for a longer time than the standard course to exhibit the maximum dehumidification effect and deodorization effect. Also, the clean storage course may be defined as a care course in which the shoe care device 100 stores shoes for a long time. As described above, various care courses may be appropriately applied to various shoes, and thus, the convenience of shoe care and user satisfaction may be improved.

The processor 1810 may determine an outdoor temperature based on a temperature measured by the second temperature sensor 1831 when the shoe care device 100 starts to operate. The door 320 may be opened to place the shoes in the chamber 330 before the start of operation of the shoe care device 100. In this case, the temperature of air in the chamber 330 is the same as the outdoor temperature. In addition, the air in the chamber 330 is not heated at the start of operation of the shoe care device 100.

Therefore, the outdoor temperature may be determined by using the second temperature sensor 1831 located at an air outlet of the chamber 330 at the start of operation of the shoe care device 100.

The heat pump device 1840 may include a compressor 1841, an evaporator 1842, a condenser, and an expansion device 1844.

The processor 1810 may determine an operating frequency of the compressor 1841 based on the target temperature and the outdoor temperature, and operate the compressor 1841 at the determined operating frequency. The target temperature and the outdoor temperature are factors that have a great influence on determining the operating frequency of the compressor 1841. For example, when the outdoor temperature is low, the processor 1810 may set the operating frequency of the compressor 1841 to a high value in order to quickly reach the temperature of air supplied into the chamber 330 to the target temperature. As a difference between the outdoor temperature and the target temperature increases, the operating frequency of the compressor 1841 may be set to a high value. Conversely, when the difference between the target temperature and the outdoor temperature is small (e.g., when the difference between the target temperature and the outdoor temperature is equal to or lower than 10° C.), the operating frequency of the compressor 1841 may be set to a small value. This is because, when the temperature in the chamber 330 rapidly increases, the temperature may exceed the target temperature.

Also, the processor 1810 may adjust the operating frequency of the compressor 1841 based on the target temperature and the temperature of air heated by the condenser 1843. That is, the processor 1810 may adjust the operating frequency of the compressor 1841 based on a first temperature measured by the first temperature sensor 1830. When the compressor 1841 operates at a fixed operating frequency for the entire operating time, the temperature of air circulating inside the sealed shoe care device 100 continuously rises, which makes it impossible to keep the target temperature constant. To prevent this, it is necessary to adjust the operating frequency of the compressor 1841.

The container 1880 is provided inside the shoe storage device 100 and stores at least one pair of shoes. The container 1880 may include a structure such as a chamber, a crack, a shelf, etc.

The sensor 1885 detects environment information inside the container 1880. The sensor 1885 may include a dust sensor, a humidity sensor, an odor sensor, etc.

The communication module 1890 communicates with an external device and transmits and receives control signals and data. The communication module 1890 may include at least one of a short-range communicator and a mobile communicator, or a combination thereof. The communication module 1890 may include at least one antenna for wirelessly communicating with other devices.

Figure 19:
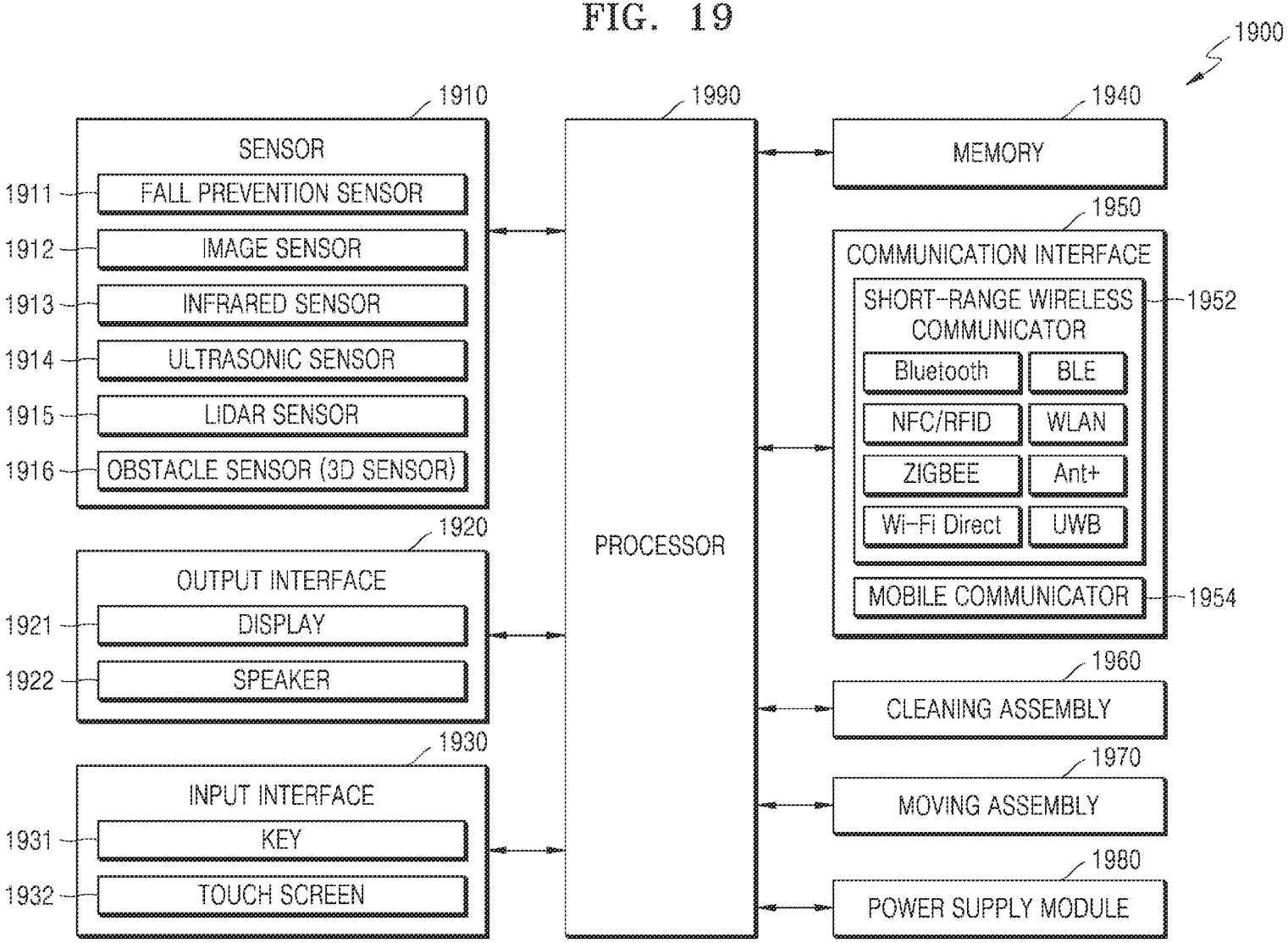
FIG. 19 is a block diagram of a structure of a robotic vacuum cleaner according to an embodiment of the disclosure.

FIG. 19 is a block diagram of a structure of a robotic vacuum cleaner according to an embodiment of the disclosure.

Referring to FIG. 19, a robotic vacuum cleaner 1900 according to an embodiment of the disclosure includes a sensor 1910, an output interface 1920, an input interface 1930, a memory 1940, a communication interface 1950, a cleaning assembly 1960, and a moving assembly 1970, a battery 1980, and a processor 1990. The robotic vacuum cleaner 1900 may be configured in various combinations of the components shown in FIG. 19, and the components shown in FIG. 19 are not all indispensable components.

The robotic vacuum cleaner 1900 of FIG. 19 corresponds to the robotic vacuum cleaner 110 described above. The sensor 1910 corresponds to the sensor 238 described with reference to FIG. 2. The memory 1940 corresponds to the second memory 240 described with reference to FIG. 2. The communication interface 1950 corresponds to the second communication module 232 described with reference to FIG. 2. The processor 1990 corresponds to the second processor 230 described with reference to FIG. 2. The moving assembly 1970 corresponds to the moving assembly 234 described with reference to FIG. 2. The cleaning assembly 1960 corresponds to the cleaning assembly 236 described with reference to FIG. 2.

The sensor 1910 may include various types of sensors, and may include, for example, at least one of a fall prevention sensor 1911, an image sensor 1912, an infrared sensor 1913, an ultrasonic sensor 1914, a lidar sensor 1915, an obstacle sensor (e.g., a 3 dimensional (3D) sensor) 1916, or a mileage detection sensor (not shown) or a combination thereof. The mileage detection sensor may include a rotation detection sensor that calculates the number of rotations of a wheel. For example, the rotation detection sensor may have an encoder installed to detect the number of rotations of a motor. A plurality of image sensors 1912 may be disposed in the robotic vacuum cleaner 1900 according to an embodiment of the disclosure. Functions of each sensor may be intuitively inferred by one of ordinary skill in the art from the name, therefore detailed descriptions thereof will be omitted.

The output interface 1920 may include at least one of a display 1921 or a speaker 1922, or a combination thereof. The output interface 1920 outputs various notifications, messages, and information generated by the processor 1990.

The input interface 1930 may include a key 1931, a touch screen 1932, etc. The input interface 1930 receives a user input and transmits the user input to the processor 1990.

The memory 1940 stores various types of information, data, an instruction, a program, etc. required for operations of the robotic vacuum cleaner 1900. The memory 1940 may include at least one of a volatile memory and a nonvolatile memory, or a combination thereof. The memory 1940 may include at least one type of storage medium among a flash memory type, a hard disk type, a multimedia card micro type, a card type memory (e.g., a secure digital (SD) or an extreme digital (XD) memory), random access memory (RAM), static RAM (SRAM), read-only memory (ROM), electrically erasable programmable ROM (EEPROM), programmable ROM (PROM), a magnetic memory, a magnetic disk, or an optical disk. Also, the robotic vacuum cleaner 1900 may correspond to a web storage or cloud server performing a storing function on the Internet.

The communication interface 1950 may include at least one or a combination of a short-range wireless communicator 1952 or a mobile communicator 1954. The communication interface 1950 may include at least one antenna for communicating with another device wirelessly.

The short-range wireless communicator 1952 may include a Bluetooth communicator, a Bluetooth low energy (BLE) communicator, a near field communicator, a wireless local region network (WLAN) (e.g., Wi-Fi) communicator, a Zigbee communicator, an infrared data association (IrDA) communicator, a Wi-Fi direct (WFD) communicator, an ultra-wideband (UWB) communicator, and an Ant+ communicator, but is not limited thereto.

The mobile communicator 1954 may transmit or receive a wireless signal to or from at least one of a base station, an external terminal, or a server, on a mobile communication network. Here, the wireless signal may include various types of data according to exchange of a voice call signal, an image call signal, or a text/multimedia message.

The cleaning assembly 1960 may include a main brush assembly installed on a lower portion of a main body to sweep or scatter dust on the floor and to suck the swept or scattered dust and a side brush assembly installed on the lower part of the main body so as to protrude to the outside and sweeping dust from a region different from a region cleaned by the main brush assembly and delivering the dust to the main brush assembly. Also, the cleaning assembly 1960 may include a vacuum cleaning module performing vacuum suction or a damp cloth cleaning module cleaning with a damp cloth.

The moving assembly 1970 moves the main body of the robotic vacuum cleaner 1900. The moving assembly 1970 may include a pair of wheels that move forward, backward, and rotate the robotic vacuum cleaner 1900, a wheel motor that applies a moving force to each wheel, and a caster wheel installed in front of the main body and of which angle is changed by rotating according to a state of a floor surface on which the robotic vacuum cleaner 1900 moves, etc. The moving assembly 1970 moves the robotic vacuum cleaner 1900 according to the control by the processor 1990. The processor 1990 determines a driving path and controls the moving assembly 1970 to move the robotic vacuum cleaner 1900 along the determined driving path.

The power supply module 1980 supplies power to the robotic vacuum cleaner 1900. The power supply module 1980 includes a battery, a power driving circuit, a converter, a transformer circuit, etc. The power supply module 1980 connects to a charging station to charge the battery, and supplies the power charged in the battery to the components of the robotic vacuum cleaner 1900.

The processor 1990 controls all operations of the robotic vacuum cleaner 1900. The processor 1990 may control the components of the robotic vacuum cleaner 1900 by executing a program stored in the memory 1940.

According to an embodiment of the disclosure, the processor 1990 may include a separate neural processing unit (NPU) performing an operation of a machine learning model. In addition, the processor 1990 may include a central processing unit (GPU), a graphics processing unit (GPU), etc.

The processor 1990 may perform operations such as operation mode control of the robotic vacuum cleaner 1900, driving path determination and control, obstacle recognition, cleaning operation control, location recognition, communication with an external server, remaining battery monitoring, battery charging operation control, etc.

The machine-readable storage medium may be provided in a form of a non-transitory storage medium. Here, 'non-transitory' only means that the storage medium is a tangible device and does not contain a signal (for example, electromagnetic waves). This term does not distinguish a case where data is stored in the storage medium semi-permanently and a case where data is stored in the storage medium temporarily. For example, the 'non-transitory storage medium' may include a buffer in which data is temporarily stored.

According to an embodiment of the disclosure, a method according to various embodiments of the disclosure may be provided by being included in a computer program product. The computer program products are products that may be traded between sellers and buyers. The computer program product may be distributed in a form of machine-readable storage medium (for example, a compact disc read-only memory (CD-ROM)), or distributed (for example, downloaded or uploaded) through an application store, or directly or online between two user devices (for example, smartphones). In the case of online distribution, at least a part of the computer program product may be at least temporarily stored or temporarily generated in the machine-readable storage medium such as a server of a manufacturer, a server of an application store, or a memory of a relay server.

According to various embodiments of the disclosure, each component (e.g., module or program) of the above-described components may include a single or plurality of entities, and some of the plurality of entities may be separately arranged in another component. According to various embodiments of the disclosure, one or more components among the above-described components, or one or more operations may be omitted, or one or more other components or operations may be added. Alternatively or additionally, a plurality of components (e.g., modules or programs) may be integrated into one component. In this case, the integrated component may perform one or more functions of each of the plurality of components in a same or similar manner as a corresponding component among the plurality of components before the integration. According to various embodiments of the disclosure, operations performed by modules, programs, or other components may be sequentially, parallelly, repetitively, or heuristically executed, one or more of the operations may be executed in a different order or omitted, or one or more other operations may be added.

According to an aspect of an embodiment of the disclosure, a method of controlling a shoe care device includes obtaining contamination level information of shoes by using at least one sensor, performing a shoe care operation in one operation mode among a plurality of operation modes, determining whether to transmit a cleaning request to at least one robotic vacuum cleaner, based on at least one of the contamination level information of shoes or the operation mode, and transmitting the cleaning request to the at least one robotic vacuum cleaner, based on determination to transmit the cleaning request.

According to an embodiment of the disclosure, the obtaining of the contamination level information of shoes includes obtaining dust contamination level information by using a dust sensor, and obtaining humidity contamination level information by using a humidity sensor.

According to an embodiment of the disclosure, the determining of whether to transmit the cleaning request includes determining to request dust cleaning from the at least one robotic vacuum cleaner, based on determination that the dust contamination level information is equal to or greater than a dust reference value, and determining to request damp cloth cleaning from the at least one robotic vacuum cleaner, based on determination that the humidity contamination level information is greater than or equal to a humidity reference value.

According to an embodiment of the disclosure, the plurality of operation modes include a first mode for removing odor and dust from shoes and removing humidity from shoes, a second mode for removing humidity from wet shoes, and a third mode for caring for shoes before going out.

According to an embodiment of the disclosure, the determining of whether to transmit the cleaning request includes determining to request dust cleaning from the at least one robotic vacuum cleaner when operating in the first mode; determining to request damp cloth cleaning from the at least one robotic vacuum cleaner when operating in the second mode, and determining not to transmit the cleaning request when operating in the third mode.

According to an embodiment of the disclosure, the determining of whether to transmit the cleaning request includes determining whether to transmit the cleaning request based on weather information, when it is determined not to transmit the cleaning request based on at least one of the contamination level information of the shoes or the operation mode being performed, determining to request dust cleaning when the weather information indicates that a fine dust value is greater than or equal to a reference value, and determining to request damp cloth cleaning in case the weather information indicates rain or snow.

According to an embodiment of the disclosure, the method may further include detecting a door opening operation of the shoe care device, detecting storage of the shoes, generating a returning home event when a door of the shoe care device is opened and shoes are newly stored, and transmitting the returning home event to a server.

According to an embodiment of the disclosure, the determining of whether to transmit the cleaning request may be performed based on detection of the returning home event.

According to an embodiment of the disclosure, the method may further include transmitting a request for activation of a lidar sensor to the at least one robotic vacuum cleaner, based on the returning home event.

According to an embodiment of the disclosure, the method may further include requesting the server to collect usage event information of at least one Internet of Things (IoT) device communicating with the server, based on the returning home event, and requesting the server to obtain user movement information based on the usage event information of the at least one IoT device.

According to an embodiment of the disclosure, the method may further include, when it is determined not to transmit the cleaning request, requesting the server to delete the obtained user movement information.

According to an embodiment of the disclosure, the method may further include, when it is determined to transmit the cleaning request, after transmitting the user movement information to the at least one robotic vacuum cleaner, requesting the server to delete the obtained user movement information.

According to an embodiment of the disclosure, wherein the at least one robotic vacuum cleaner generates a cleaning path based on the obtained user movement information, wherein the at least one robotic vacuum cleaner performs cleaning based on the generated cleaning path.

According to an embodiment of the disclosure, wherein the cleaning path includes a peripheral space of the at least one IoT device.

According to an embodiment of the disclosure, the method may further include, when it is determined to transmit the cleaning request based on the returning home event, and the user movement information is not generated by the at least one robotic vacuum cleaner to receive the cleaning request or the server, requesting the at least one robotic vacuum cleaner to receive the cleaning request to clean a previously determined area.

According to an embodiment of the disclosure, wherein the plurality of operation modes include at least one operation mode corresponding to a type of shoes, wherein the operation mode includes at least one type of cleaning corresponding to each type of shoes, and wherein types of cleaning include dust cleaning and damp cloth cleaning According to an embodiment of the disclosure, wherein types of shoes include hiking boots, shoes, golf shoes, rain boots, boots, and wet sneakers.

According to an aspect of an embodiment of the disclosure, a shoe care device includes a container storing at least one pair of shoes, at least one sensor configured to measure a contamination level of the at least one pair of shoes stored in the container, a shoe care module configured to care for a state of the at least one pair of shoes inside the container, a communication module, a memory storing at least one instruction, and at least one processor connected to the memory, wherein the at least one processor is configured to execute the at least one instruction to obtain contamination level information of shoes by using a measurement value of the at least one sensor, control the shoe care module to perform a shoe care operation in one operation mode among a plurality of operation modes, determine whether to transmit a cleaning request to the at least one robotic vacuum cleaner, based on at least one of the contamination level information of shoes or the operation mode, and control the communication module to transmit a cleaning request to the at least one robotic vacuum cleaner, based on determination to transmit the cleaning request.

According to an aspect of an embodiment of the disclosure, provided is a computer-readable recording medium having recorded thereon a computer program for performing the method of controlling the shoe care device, on a computer.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A method performed by a shoe care device, the method comprising:

obtaining contamination level information of shoes by using at least one sensor;

performing a shoe care operation in one operation mode among a plurality of operation modes;

determining whether to transmit a cleaning request to at least one robotic vacuum cleaner, based on at least one of the contamination level information of shoes or the operation mode; and transmitting the cleaning request to the at least one robotic vacuum cleaner, based on a determination to transmit the cleaning request, wherein the at least one robotic vacuum cleaner is external to the shoe care device.

2. The method of claim 1, wherein the obtaining of the contamination level information of shoes comprises:

obtaining dust contamination level information by using a dust sensor; and obtaining humidity contamination level information by using a humidity sensor.

3. The method of claim 2, wherein the determining of whether to transmit the cleaning request comprises:

determining to request dust cleaning from the at least one robotic vacuum cleaner, based on a determination that the dust contamination level information is equal to or greater than a dust reference value; and determining to request damp cloth cleaning from the at least one robotic vacuum cleaner, based on a determination that the humidity contamination level information is greater than or equal to a humidity reference value.

4. The method of claim 1, wherein the plurality of operation modes comprise a first mode for removing odor and dust from shoes and removing humidity from shoes, a second mode for removing humidity from wet shoes, and a third mode for caring for shoes before going out.

5. The method of claim 4, wherein the determining of whether to transmit the cleaning request comprises:

determining to request dust cleaning from the at least one robotic vacuum cleaner when operating in the first mode;

determining to request damp cloth cleaning from the at least one robotic vacuum cleaner when operating in the second mode; and determining not to transmit the cleaning request when operating in the third mode.

6. The method of claim 1, wherein the determining of whether to transmit the cleaning request comprises:

determining whether to transmit the cleaning request based on weather information, when it is determined not to transmit the cleaning request based on at least one of the contamination level information of the shoes or the operation mode being performed;

determining to request dust cleaning when the weather information indicates that a fine dust value is greater than or equal to a reference value; and determining to request damp cloth cleaning in case the weather information indicates rain or snow.

7. The method of claim 1, further comprising:

detecting a door opening operation of the shoe care device;

detecting storage of the shoes;

generating a returning home event when a door of the shoe care device is opened and shoes are newly stored; and transmitting the returning home event to a server.

8. The method of claim 7, wherein the determining of whether to transmit the cleaning request is performed based on detection of the returning home event.

9. The method of claim 7, further comprising:

transmitting a request for activation of a lidar sensor to the at least one robotic vacuum cleaner, based on the returning home event.

10. The method of claim 7, further comprising:

requesting the server to collect usage event information of at least one Internet of Things (IoT) device communicating with the server, based on the returning home event; and requesting the server to obtain user movement information based on the usage event information of the at least one IoT device.

11. The method of claim 10, further comprising:

when it is determined not to transmit the cleaning request, requesting the server to delete the obtained user movement information.

12. The method of claim 10, further comprising:

when it is determined to transmit the cleaning request, after transmitting the user movement information to the at least one robotic vacuum cleaner, requesting the server to delete the obtained user movement information.

13. The method of claim 10, wherein the at least one robotic vacuum cleaner generates a cleaning path based on the obtained user movement information, wherein the at least one robotic vacuum cleaner performs cleaning based on the generated cleaning path.

14. The method of claim 13, wherein the cleaning path includes a peripheral space of the at least one IoT device.

15. The method of claim 10, further comprising:

when it is determined to transmit the cleaning request based on the returning home event, and the user movement information is not generated by the at least one robotic vacuum cleaner to receive the cleaning request or the server, requesting the at least one robotic vacuum cleaner to receive the cleaning request to clean a previously determined area.

16. The method of claim 1, wherein the plurality of operation modes include at least one operation mode corresponding to a type of shoes, wherein the operation mode includes at least one type of cleaning corresponding to each type of shoes, and wherein types of cleaning include dust cleaning and damp cloth cleaning.

17. The method of claim 16, wherein types of shoes include hiking boots, shoes, golf shoes, rain boots, boots, and wet sneakers.

18. A shoe care device comprising:

a container storing at least one pair of shoes;

at least one sensor configured to measure a contamination level of the at least one pair of shoes stored in the container;

a shoe care module configured to care for a condition of the at least one pair of shoes inside the container;

a communication module;

a memory storing at least one instruction; and at least one processor connected to the memory, wherein the at least one processor is configured to execute the at least one instruction to:

obtain contamination level information of shoes by using a measurement value of the at least one sensor, control the shoe care module to perform a shoe care operation in one operation mode among a plurality of operation modes, determine whether to transmit a cleaning request to at least one robotic vacuum cleaner, based on at least one of the contamination level information of shoes or the operation mode, and control the communication module to transmit a cleaning request to the at least one robotic vacuum cleaner, based on a determination to transmit the cleaning request.

19. The shoe care device of claim 18, wherein the at least one sensor comprises a dust sensor and a humidity sensor, and wherein the at least one processor is further configured to execute the at least one instruction to:

obtain dust contamination level information by using the dust sensor, and obtain humidity contamination level information by using the humidity sensor.

20. A non-transitory computer readable recording medium having recorded thereon a program for performing the method of claim 1, on a computer.

* * * * *